US009977383B2

(12) United States Patent
Noda et al.

(10) Patent No.: US 9,977,383 B2
(45) Date of Patent: May 22, 2018

(54) POWDER COATING APPARATUS

(71) Applicant: FUJI XEROX CO., LTD., Tokyo (JP)

(72) Inventors: Akihiko Noda, Kanagawa (JP); Masato Mikami, Kanagawa (JP); Satoshi Yoshida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 328 days.

(21) Appl. No.: 14/826,768

(22) Filed: Aug. 14, 2015

(65) Prior Publication Data

US 2016/0279667 A1 Sep. 29, 2016

(30) Foreign Application Priority Data

Mar. 26, 2015 (JP) ..... 2015-065236

(51) Int. Cl.
*B05C 9/06* (2006.01)
*G03G 15/34* (2006.01)

(52) U.S. Cl.
CPC ..... *G03G 15/346* (2013.01); *B05C 9/06* (2013.01)

(58) Field of Classification Search
None
See application file for complete search history.

(56) References Cited

U.S. PATENT DOCUMENTS 5,613,178 A * 3/1997 Amico ..... G03G 15/0818 399/266
5,955,152 A 9/1999 Yasuda et al.
6,086,675 A * 7/2000 Hamamoto ..... H01T 19/00 118/620
6,198,492 B1 * 3/2001 Wakahara ..... B41J 2/4155 347/141
2002/0050061 A1 * 5/2002 Komyoji ..... H01J 9/02 29/846
2002/0086104 A1 7/2002 Yabuta et al.
2003/0001925 A1 * 1/2003 Ogawa ..... B41J 2/4155 347/55
2005/0165133 A1 7/2005 Sacripante et al.
2010/0111556 A1 * 5/2010 Shibuya ..... G03G 15/0275 399/71
2013/0337190 A1 * 12/2013 Ramanujan ..... B41J 3/407 427/559

FOREIGN PATENT DOCUMENTS

JP H08-272213 A 10/1996
JP H10-43670 A 2/1998
JP 2000-221780 A 8/2000
JP 2001-106959 A 4/2001
JP 2005-211900 A 8/2005

* cited by examiner

*Primary Examiner* — Charles Capozzi
(74) *Attorney, Agent, or Firm* — Oliff PLC

(57) ABSTRACT

A powder coating apparatus includes: a transport device that transports an object to be coated; an applying unit disposed to be opposed to a surface to be coated of the transported object to be coated and applying a charged thermosetting powder coating material onto the surface to be coated of the object to be coated, that includes an applying section including a cylindrical or columnar applying member that is disposed to be separated from the surface to be coated of the object to be coated, and a supplying section including a cylindrical or columnar supplying member that supplies the powder coating material onto the surface of the applying member; a voltage applying device; and a heating device.

19 Claims, 11 Drawing Sheets

POWDER COATING APPARATUS

CROSS-REFERENCE TO RELATED APPLICATIONS

This application is based on and claims priority under 35 USC 119 from Japanese Patent Application No. 2015-065236 filed Mar. 26, 2015.

BACKGROUND

1. Technical Field

The present invention relates to a powder coating apparatus.

2. Related Art

In recent years, with a powder coating technique using a powder coating material, the amount of volatile organic compounds (VOC) emitted in a coating process is small and the powder coating material that has not been adhered to an object to be coated may be collected after the coating process in order to be recycled, and thus the technique has received attention in terms of the global environment.

SUMMARY

According to an aspect of the invention, there is provided a powder coating apparatus, including:

a transport device that transports an object to be coated;

an applying unit disposed to be opposed to a surface to be coated of the transported object to be coated and applying a charged thermosetting powder coating material onto the surface to be coated of the object to be coated, wherein the applying unit includes an applying section including a cylindrical or columnar applying member that is disposed to be separated from the surface to be coated of the object to be coated, is rotated in a direction identical to or opposite from a transport direction of the object to be coated, and transfers and applies the powder coating material attached to the surface onto the surface to be coated of the object to be coated according to a potential difference between the applying member and the surface to be coated of the object to be coated, and a supplying section including a cylindrical or columnar supplying member that supplies the powder coating material onto the surface of the applying member;

a voltage applying device that includes a voltage applying unit applying a voltage in which an alternating voltage is superimposed with a direct voltage applying a potential difference between the applying member and the surface to be coated of the object to be coated; and a heating device that heats and thermally cures a powder particle layer of the powder coating material applied onto the surface to be coated of the object to be coated.

BRIEF DESCRIPTION OF THE DRAWINGS

Exemplary embodiments of the present invention will be described in detail based on the following figures, wherein.

DETAILED DESCRIPTION

Figure 1:
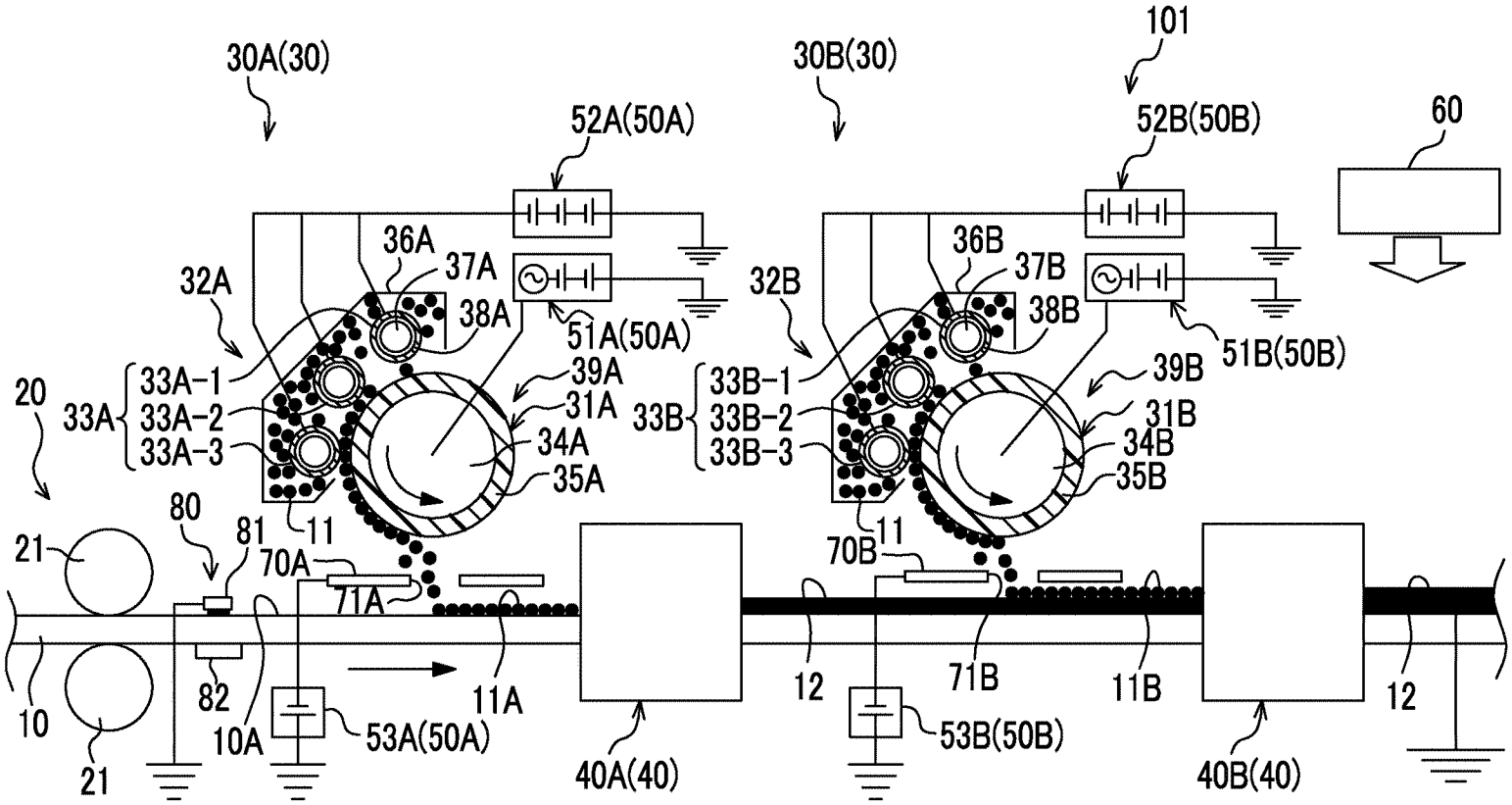
FIG. 1 is a schematic view illustrating an example of a configuration of a powder coating apparatus according to a first exemplary embodiment.

Hereinafter, an exemplary embodiment which is an example of the invention will be described with reference to the drawings. Furthermore, the same reference numerals are applied to devices or the like having substantially the same function and action through all the drawings. Thus, repeated description will be omitted.

First Exemplary Embodiment

FIG. 1 is a schematic view illustrating an example of a configuration of a powder coating apparatus according to a first exemplary embodiment.

As illustrated in FIG. 1, a powder coating according to the first exemplary embodiment, for example, includes a transport device 20 which transports an object to be coated 10, an applying unit 30 which is arranged to be opposed to a surface to be coated 10A of the object to be coated 10 to be transported, and applies a charged thermosetting powder coating material 11 onto the surface to be coated 10A of the object to be coated 10, a heating device 40 which heats and thermally cures a powder particle layer 11A (hereinafter, simply referred to as a "powder particle layer 11A") of the powder coating material 11 applied onto the surface to be coated 10A of the object to be coated 10, and an erasing device 80 which erases the surface to be coated 10A of the object to be coated 10 on an upstream side of the applying unit 30 in a transport direction of the object to be coated 10 from. In addition, in the powder coating apparatus 101, a voltage applying device 50 for forming a potential difference between the respective members by applying a voltage to the respective members is also provided.

Then, powder coating apparatus 101 includes a control device 60 which is connected to the respective devices and members in the powder coating apparatus 101 to control the operation of the respective devices and members.

Object to be Coated

Examples of the object to be coated 10 include a plate-shaped object made of metal, ceramic, or a resin. A surface treatment such as a primer treatment, a plating treatment, or an electrophoretic coating may also be performed in advance on the surface to be coated 10A of the object to be coated 10.

From the viewpoint that the powder coating material 11 is caused to electrostatically adhere to the object to be coated 10, at least the surface to be coated thereof may preferably have conductivity. Here, conductivity means a volume resistivity of equal to or less than $10^{13}$ Ωcm. In addition, from the viewpoint that the powder coating material 11 is caused to electrostatically adhere to the object to be coated 10, a voltage may be applied to the object to be coated 10 such that the polarity of the object to be coated 10 or the surface to be coated thereof is opposite to the polarity of the charged powder coating material 11, or the object to be coated 10 may be grounded (earthed).

In addition, in the first exemplary embodiment, a conductive steel sheet is applied as the object to be coated 10, and a form in which the conductive steel sheet is grounded is illustrated.

Transport Device

The transport device 20 includes, for example, a pair of transport rolls 21 and a roll driving portion (for example, motor) (not illustrated). A single pair or plural pairs of transport rolls 21 are provided. The transport device 20 may include a transport belt in addition to the pair of transport rolls 21 or instead of the pair of transport rolls 21.

Applying Unit

Figure 2:
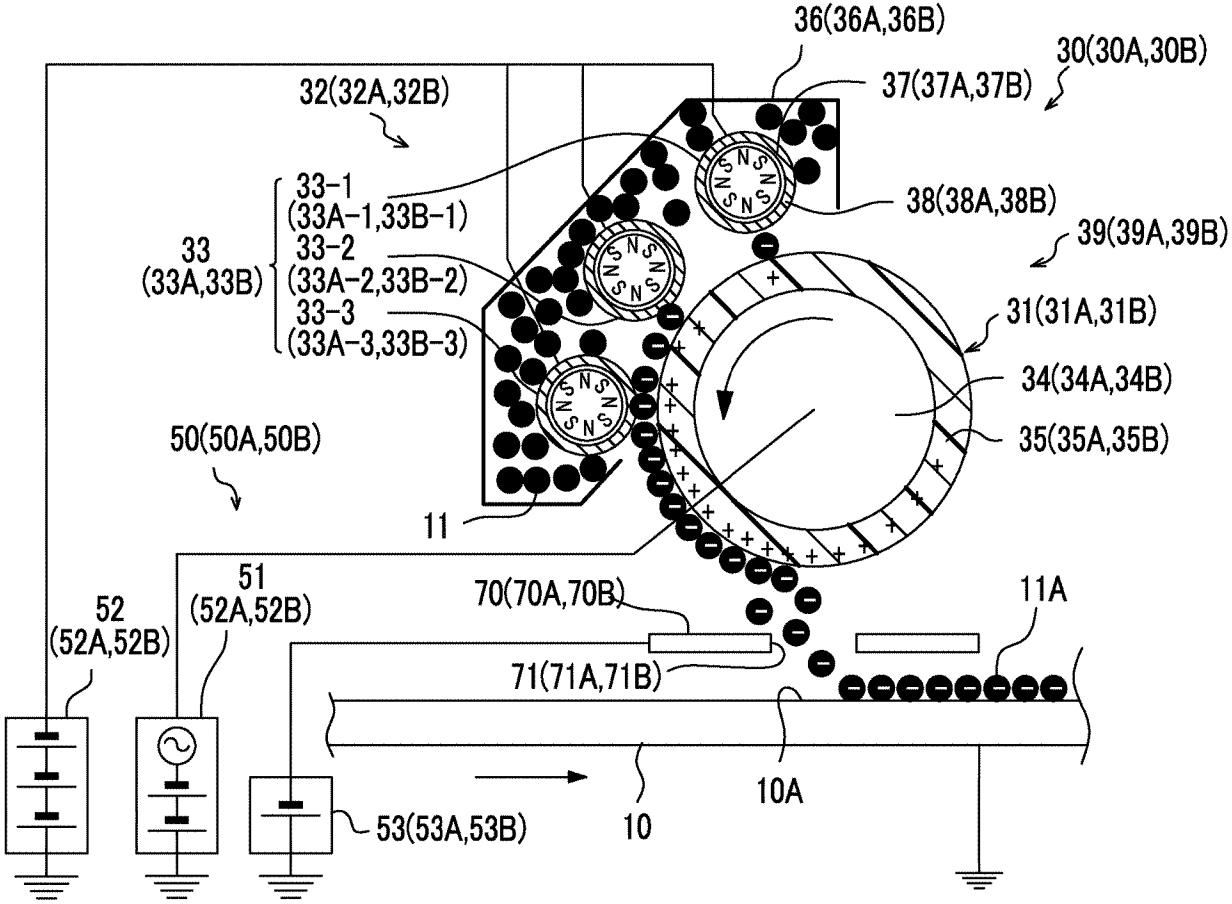
FIG. 2 is an enlarged schematic view illustrating a peripheral portion of an applying unit of the powder coating apparatus according to the first exemplary embodiment.

As illustrated in FIGS. 1 and 2, the applying unit 30 is constituted by a first applying unit 30A and a second applying unit 30B which is disposed on the downstream side of the first applying unit 30A in a transport direction of the object to be coated 10. The applying unit 30 may be constituted by a single applying unit 30 or may also be constituted by plural applying units, for example, three or more applying units 30.

In the applying unit 30, the first applying unit 30A and the second applying unit 30B are applying units which apply powder coating materials 11 with different colors onto the surface to be coated 10A of the object to be coated 10.

Here, in a case where the applying unit 30 is constituted by the plural applying units, for example, three or more applying units, at least one applying unit 30 among the plural applying units may be an applying unit which applies a powder coating material 11 having a different color from those of the other applying units 30 onto the surface to be coated 10A of the object to be coated 10. The color of the powder coating material 11 is selected depending on the color of a coating film 12 to be formed. In addition, the plural applying units may also be applying units 30 which apply powder coating materials 11 having the same color onto the surface to be coated 10A of the object to be coated 10.

The first and second applying units 30A and 30B include, respectively, applying units 39A and 39B including cylindrical or columnar applying rolls 31A and 31B (an example of an applying member) which are disposed to be separated from the surface to be coated 10A of the object to be coated 10, are rotated in a direction identical to or opposite from the transport direction of the object to be coated 10 (for example, in the first exemplary embodiment, a direction identical to the transport direction), and apply the powder coating material 11 attached to the surface thereof onto the surface to be coated 10A of the object to be coated 10 by being transferred thereto according to the potential difference between the applying rolls 31A and 31B and the surface to be coated 10A of the object to be coated 10, and supplying sections 32A and 32B including cylindrical or columnar supplying rolls 33A and 33B (an example of a supplying member) which supply the powder coating material 11 onto the surface of the applying rolls 31A and 31B.

Although not illustrated, the first and second applying units 30A and 30B may respectively have, for example, driving portions (for example, motors) which rotary drive the applying rolls 31A and 31B and driving portions (for example, motors) which rotary drive the supplying rolls 33.

The applying rolls 31A and 31B are respectively constituted by a roll member including, for example, cylindrical or columnar conductive rolls 34A and 34B, and resistive layers 35A and 35B provided on the outer circumferential surfaces of the conductive rolls 34A and 34B. In addition, instead of the applying rolls 31A and 31B, an applying belt may also be applied as the applying member.

Each of the conductive rolls 34A and 34B may be configured of, for example, a metallic member including a metal (aluminum, copper, zinc, chromium, nickel, molybdenum, vanadium, indium, gold, platinum, or the like) or an alloy (stainless steel, an aluminum alloy, or the like). Otherwise, each of the conductive rolls 34A and 34B may also be configured of, for example, a resin member provided with a metal layer or an alloy layer on its outer circumferential surface.

Each of the resistive layers 35A and 35B contains, for example, a rubber or a resin, and a conductive material. Examples of the rubber include well-known rubbers such as isoprene rubber, chloroprene rubber, and epichlorohydrin rubber. Examples of the resin include well-known resins such as polyamide resin, polyester resin, and polyimide resin. Examples of the conductive material include well-known conductive materials including: carbon blacks such as ketjen black and acetylene black; metals or alloys such as aluminum and copper; and metal oxides such as tin oxide and indium oxide.

In addition, the volume resistivity of each of the resistive layers 35A and 35B is, for example, from $10^5$ Ωcm to $10^{10}$ Ωcm (preferably, from $10^6$ Ωcm to $10^8$ Ωcm).

The thickness of the resistive layers 35A and 35B is, for example, from 20 μm to 100,000 μm.

The supplying sections 32A and 32B respectively include, for example, housings 36A and 36B having openings on the sides that is opposed to the applying rolls 31A and 31B, and the supplying rolls 33A and 33B which are provided to be opposed to the applying rolls 31A and 31B at the openings of the housings 36A and 36B.

The supplying rolls 33A and 33B are configured of roll members respectively including, for example, cylindrical or columnar magnet rolls 37A and 37B in which the magnetic poles are alternately switched in a circumferential direction, and conductive sleeves 38A and 38B which are concentrically disposed on the outsides of the magnet rolls 37A and 37B.

The supplying rolls 33A and 33B are respectively constituted by first supplying rolls 33A-1 and 33B-1, second supplying rolls 33A-2 and 33B-2, and third supplying rolls 33A-3 and 33B-3. The first supplying rolls 33A-1 and 33B-1, the second supplying rolls 33A-2 and 33B-2, and the third supplying rolls 33A-3 and 33B-3 are arranged in this order from the upstream side to the downstream side in the rotation direction of the applying rolls 31A and 31B.

The supplying roll 33A or 33B may be configured of a single supplying roll 33A or 33B, two supplying rolls 33A or 33B, or plural supplying rolls, for example, four or more supplying rolls 33A or 33B.

Each of the supplying sections 32A and 32B (the insides of the housings 36A and 36B thereof) accommodates, for example, the powder coating material 11 and a magnetic carrier (not illustrated) for charging the powder coating material 11. In the housings 36A and 36B of the supplying sections 32A and 32B, agitation members (for example, augers) (not illustrated) are provided. In addition, when the powder coating material 11 and the magnetic carrier are agitated by the agitation member, the powder coating material 11 is charged. In the first exemplary embodiment, an example of negatively charging the powder coating material 11 is illustrated.

Here, in order to charge the powder coating material 11, as the magnetic carrier, for example, magnetic material particles such as ferrite particles or magnetic material particles having a resin coating layer on the surface thereof are applied.

Here, in the first and second applying units 30A and 30B, between the surface to be coated 10A of the object to be coated 10 and the applying rolls 31A and 31B, for example, electrode plates 70A and 70B including slits (an example of an opening portion) 71A and 71B are disposed, respectively. The electrode plates 70A and 70B are disposed such that the slits 71A and 71B are positioned in a position where the surface to be coated 10A of the object to be coated 10 faces the applying rolls 31A and 31B. Then, the slits 71A and 71B of electrode plates 70A and 70B are elongated slits in which a longitudinal direction is along an axis direction of the applying rolls 31A and 31B.

The electrode plates 70A and 70B are members which are disposed in the powder coating apparatus 101, as necessary.

Hereinafter, in the description of the first and second applying units 30A and 30B and the constituent members thereof, for example, denotement is made as the applying unit 30 and the like, and there may be cases where "A" and "B" in reference numerals are omitted.

Heating Device

The heating device 40 is constituted by, for example, a first heating device 40A which heats and thermally cures the powder particle layer 11A applied onto the surface to be coated 10A of the object to be coated 10 by the first applying unit 30A, and a second heating device 40B which heats and thermally cures the powder particle layer 11A applied onto the surface to be coated 10A of the object to be coated 10 by the second applying unit 30B.

The heating device 40 may also be constituted by a single heating device, or plural heating devices, for example, three or more heating devices 40 depending on the number of applying units 30. The plural heating devices 40 respectively heat and thermally cure the powder particle layers 11A applied onto the surface to be coated 10A of the object to be coated 10 by the plural applying units 30.

However, even in a case where the plural applying units 30 are provided, the heating device 40 may also be configured of a single heating device 40. In this case, the single heating device 40 is on the downstream side, in the transport direction of the object to be coated 10, of the applying unit 30 provided on the most downstream side among the plural applying units 30 in the transport direction of the object to be coated 10. In addition, the single heating device 40 collectively heats and thermally cures all the powder particle layers 11A applied onto the surface to be coated 10A of the object to be coated 10 by the plural applying units 30.

Furthermore, units each of which including the plural applying units 30 and the single heating device 40 may further be arranged in the transport direction of the object to be coated 10.

Each of the first and second heating devices 40A and 40B includes, for example, a heat source although not illustrated. The heat source is disposed to be opposed to the powder particle layer 11A formed on the surface to be coated 10A of the transported object to be coated 10. Examples of the heat source include known heat sources such as a halogen lamp, a ceramic heater, and an infrared lamp.

The first and second heating devices 40A and 40B may be laser irradiating devices which emit infrared lasers to heat the powder particle layer 11A.

Hereinafter, in the description of the first and second heating devices 40A and 40B, for example, denotement is made as the heating device 40 and the like, and there may be cases where "A" and "B" in reference numerals are omitted.

Voltage Applying Device

The voltage applying device 50 includes a first voltage applying device 50A for the first applying unit 30A, and a second voltage applying device 50B for the second applying unit 30B.

The voltage applying device 50 may be constituted by a single, or plural voltage applying devices, for example, three or more voltage applying devices 50 depending on the number of applying units 30.

The first and second voltage applying devices 50A and 50B respectively include voltage applying units 51A and 51B which are electrically connected to the applying rolls 31A and 31B (the conductive roll 34A thereof), voltage applying units 52A and 52B electrically connected to the supplying rolls 33A and 33B (the conductive sleeves 38A and 38B thereof), and voltage applying units 53A and 53B which are electrically connected to the electrode plates 70A and 70B, in the first and second applying units 30A.

The voltage applying units 51A and 51B are configured of various power sources which apply a voltage in which an alternating voltage is superimposed with a direct voltage for applying a potential difference between the applying rolls 31A and 31B and the surface to be coated 10A of the object to be coated 10. In the respective voltage applying units 51A and 51B, for example, a terminal having one polarity is electrically connected to the applying rolls 31A and 31B (the conductive rolls 34A and 34B thereof), and a terminal having the other polarity is grounded.

The voltage applying units 52A and 52B are configured of various power sources which apply the direct voltage for applying the potential difference between the supplying rolls 33A and 33B and the applying rolls 31A and 31B. In the respective voltage applying units 52A and 52B, for example, a terminal having one polarity is electrically connected to the supplying rolls 33A and 33B (the conductive sleeves 38A and 38B thereof), and a terminal having the other polarity is grounded.

The voltage applying units 53A and 53B are configured of various power sources which apply the direct voltage for applying the potential difference between the electrode plates 70A and 70B and the applying rolls 31A and 31B, and between the electrode plates 70A and 70B and the surface to be coated 10A of the object to be coated 10. In the respective voltage applying units 53A and 53B, for example, a terminal having one polarity is electrically connected to the electrode plates 70A and 70B, and a terminal having the other polarity is grounded.

In the respective voltage applying units of the first and second voltage applying devices 50A and 50B, for example, the supplying rolls 33A and 33B (the conductive sleeves 38A and 38B thereof), the applying rolls 31A and 31B (the conductive rolls 34A and 34B thereof), and the electrode plates 70A and 70B are sequentially connected to the respective members in this order such that the voltage is applied with which the potential (an absolute value) of the supplying rolls 33A and 33B (the conductive sleeves 38A and 38B thereof) is maximized.

Here, in the first exemplary embodiment, an aspect is described in which a voltage having a negative polarity is applied to the supplying rolls 33A and 33B (the conductive sleeves 38A and 38B thereof), the applying rolls 31A and 31B (the conductive rolls 34A and 34B thereof), and the electrode plates 70A and 70B by the respective voltage applying units of the first and second voltage applying devices 50A and 50B.

Furthermore, hereinafter, in the description of the first and second voltage applying devices 50A and 50B, for example, the first and second voltage applying devices 50A and 50B may be described as the "voltage applying device 50" and the like, and there may be cases where "A" and "B" in reference numerals are omitted.

Erasing Device

The erasing device 80 is disposed on the upstream side of the applying unit 30 in the transport direction of the object to be coated 10. The erasing device 80, for example, includes an erasing brush 81 which is disposed to be opposed to the surface to be coated 10A of the object to be coated 10, and a counter electrode 82 which is disposed to be opposed to a surface opposite to the surface to be coated 10A of the object to be coated 10. The erasing brush 81 and the counter electrode 82 are grounded, respectively.

In the erasing device 80, the grounded erasing brush 81 is in contact with the surface to be coated 10A of the object to be coated 10, and thus erasing is performed.

The erasing device 80 is not limited to an erasing brush type erasing device using the erasing brush 81. For example, examples of the erasing device 80 include a roll type contact erasing device using an erasing roll; a non-contact erasing device using corona discharge or a soft X-ray, and the like.

Furthermore, the erasing device 80 is disposed in the powder coating apparatus 101, as necessary.

Control Device

Figure 3:
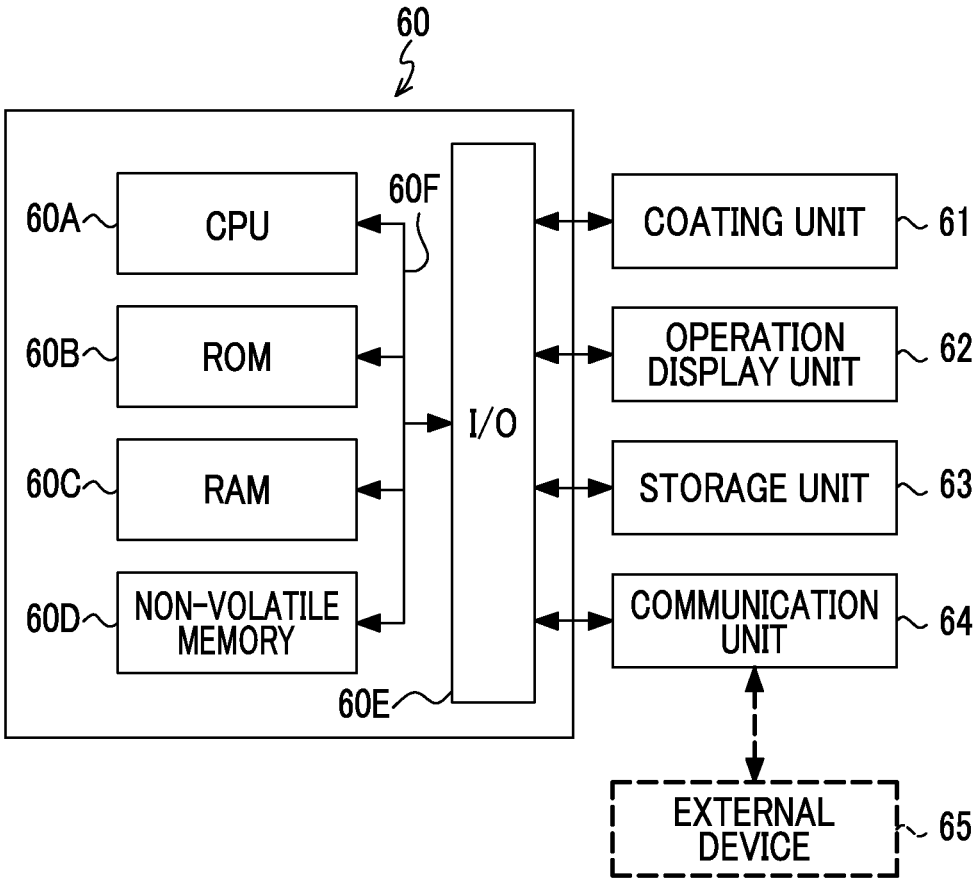
FIG. 3 is a block diagram illustrating an example of a configuration of a control system of the powder coating apparatus according to the first exemplary embodiment.

The control device 60 is configured as a computer which controls the entire apparatus and performs various operations. Specifically, as illustrated in FIG. 3, the control device 60 includes, for example, a central processing unit (CPU) 60A, a read only memory (ROM) 60B which stores various programs, a random access memory (RAM) 60C which is used as a work area during execution of the programs, a non-volatile memory 60D which stores various types of information, and an input/output interface (I/O) 60E. The CPU 60A, the ROM 60B, the RAM 60C, the non-volatile memory 60D, and the I/O 60E are connected to each other via a bus 60F.

In addition, each of a coating unit 61, an operation display unit 62, a storage unit 63, and a communication unit 64 is connected to the I/O 60E of the control device 60. The control device 60 transmits and receives information to and from each of the operation display unit 62, the storage unit 63, and the communication unit 64 to control each of the units.

The coating unit 61 is described as a main configuration of the powder coating apparatus 101. That is, the coating unit 61 is connected to each of other devices (not illustrated) necessary for the powder coating such as the transport device 20, each member of the applying unit 30 (or a driving unit thereof), the heating device 40, the voltage applying device 50, and the erasing device 80. The control device 60 controls each of the devices by transmitting and receiving information between the respective devices.

The operation display unit 62 includes, for example, various buttons such as a start button and a numeric keypad, a touch panel for displaying various screens such as a warning screen and a setting screen, and the like. The operation display unit 62 receives an operation from a user and displays various types of information for the user with the above-described configuration.

The storage unit 63 includes, for example, a storage device such as a hard disk. The storage unit 63 stores, for example, various types of data such as log data and various programs.

The communication unit 64 is, for example, an interface for communication with an external device 65 via a wired or wireless communication line. For example, the communication unit 64 acquires coating instructions or coating information from the external device 65.

In addition, for example, various types of drives may also be connected to the control device 60. Various types of drives are, for example, devices that read data from a computer-readable portable recording medium such as a flexible disk, a magneto-optical disc, a CD-ROM, a DVD-ROM, or a USB memory or write data on the recording medium. In a case where the various types of drives are included, control programs may be recorded on the portable recording medium and may be read by corresponding drives to be executed.

Operation of Powder Coating Apparatus

Next, an example of the operation of the powder coating apparatus 101 according to the first exemplary embodiment will be described. Furthermore, the operation of the powder coating apparatus 101 is performed by various programs executed in the control device 60.

When the powder coating apparatus 101 receives a coating instruction or the like from the external device 65, for example, via the operation display unit 62 or the communication unit 64, the powder coating apparatus 101 acquires coating information received along with the coating instruction. The acquired coating information is stored in, for example, the RAM 60C.

Next, the object to be coated 10 is transported by the transport device 20 according to the acquired coating information. Specifically, for example, in the transport device 20, the pair of transport rolls 21 are driven by the driving portion (not illustrated) to transport the object to be coated 10. Then, the surface to be coated 10A of the object to be coated 10 is erased by the erasing device 80.

Next, for example, the charged powder coating material 11 is applied onto the surface to be coated 10A of the object to be coated 10 by each of the first and second applying units 30A and 30B. That is, after the charged powder coating material 11 is applied onto the surface to be coated 10A of the object to be coated 10 by the first applying unit 30A, in addition to the powder particle layer 11A of this powder coating material 11, the charged powder coating material 11 is further applied by the second applying unit 30B onto the powder particle layer 11A of the powder coating material 11 formed by the first applying unit 30A. Here, in the first exemplary embodiment, the charged powder coating material 11 is applied by the second applying unit 30B onto the powder particle layer 11A after being thermally cured.

Specifically, for example, in the first and second voltage applying devices 50A and 50B, a voltage in which an alternating voltage is superimposed with a direct voltage (a negative voltage) is applied to the applying rolls 31A and 31B (the conductive rolls 34A and 34B thereof) by the voltage applying units 51A and 51B. In addition, a direct voltage (a negative voltage) is applied to the supplying rolls 33A and 33B (the conductive sleeves 38A and 38B thereof) by the voltage applying units 52A and 52B. Further, a direct voltage (a negative voltage) is applied to the electrode plates 70A and 70B (the conductive sleeves 38A and 38B thereof) by the voltage applying units 53A and 53B.

In this state, in the first and second applying units 30A and 30B, the supplying rolls 33A and 33B are rotary-driven respectively by the driving portions (not illustrated) in the same direction as the transport direction of the object to be coated 10. In addition, the supplying rolls 33A and 33B are rotary-driven by the driving portions (not illustrated) in the same direction as the rotation direction of the applying rolls 31A and 31B. Otherwise, the supplying rolls 33A and 33B may also be rotary-driven in the opposite direction to the rotation direction of the applying rolls 31A and 31B.

At this time, by the voltage applied to the conductive sleeves 38A and 38B on the surface of the supplying rolls 33A and 33B and the magnetic force of the magnet rolls 37A and 37B in the supplying rolls 33A and 33B, plural magnetic carriers (not illustrated) are held in rows in a bristled form on the surfaces of the supplying rolls 33A and 33B, respectively. In addition, the powder coating material 11 which is, for example, negatively charged, adheres to the surface of the magnetic carriers. In this state, the plural magnetic carriers held in rows in a bristled form are moved, respectively, to positions that is opposed to the conductive rolls 34A and 34B of the applying rolls 31A and 31B by the rotation of the supplying rolls 33A and 33B. Since a voltage (negative voltage) having a lower potential than that of the supplying rolls 33A and 33B is applied to each of the conductive rolls 34A and 34B of the applying rolls 31A and 31B, each of the outer circumferential surfaces of the resistive layers 35A and 35B provided on the outer circumferential surfaces of the conductive rolls 34A and 34B has a potential that is more positive than that of the supplying rolls 33A and 33B. Therefore, when the magnetic carriers are moved to the positions that is opposed to the surfaces of the conductive rolls 34A and 34B of the applying rolls 31A and 31B, the powder coating material 11 that adheres to the surfaces of the plural magnetic carriers held in rows in a bristled form is transferred to the surfaces of the applying rolls 31A and 31B.

In addition, the supply of the powder coating material 11 to the applying roll 31 from the supplying roll 33 is performed over the entire surface from one end to the other end of the applying roll 31 in the axial direction.

On the other hand, the object to be coated 10 is grounded. For this reason, the powder coating material 11 attached to the surface of each of the applying rolls 31A and 31B is transferred onto the surface to be coated 10A of the object to be coated 10 by the potential difference between the applying rolls 31A and 31B and the surface to be coated 10A of the object to be coated 10. Accordingly, the powder coating material 11 attached to the surface of each of the applying rolls 31A and 31B is applied onto the surface to be coated 10A of the object to be coated 10.

Here, the potential difference respectively exists between the applying rolls 31A and 31B and the electrode plates 70A and 70B, and between the electrode plates 70A and 70B and the surface to be coated 10A of the object to be coated 10. For this reason, the powder coating material 11 attached to the surface of the applying rolls 31A and 31B is transferred onto the surface to be coated 10A of the object to be coated 10 through the slits 71A and 71B of the electrode plates 70A and 70B.

Depending on the acquired coating information, there may be cases where the charged powder coating material 11 is applied onto the surface to be coated 10A of the object to be coated 10 only by the first applying unit 30A.

Next, the powder particle layer 11A applied by the first applying unit 30A onto the surface to be coated 10A of the object to be coated 10 is heated by the first heating device 40A so as to be thermally cured. In addition, the powder particle layer 11A applied by the second applying unit 30B onto the surface to be coated 10A of the object to be coated 10 is heated by the second heating device 40B so as to be thermally cured.

In addition, when the thermosetting resin of the powder particles is a curable polyester resin, the heating temperature (baking temperature) of each powder particle layer 11A is preferably from 90° C. to 250° C., more preferably from 100° C. to 220° C., and even more preferably from 120° C. to 200° C. Such a temperature range of the heating temperature (baking temperature) varies depending on the curing temperature properties of the thermosetting resin.

Through the steps described above, the coating film 12 is formed on the surface to be coated 10A of the object to be coated 10, and thus the coating of the powder coating material 11 is performed.

Here, the coating of the powder coating material 11 (that is, the formation of the coating film 12) is obtained by transferring the powder coating material 11 to the surface to be coated 10A of the object to be coated 10 from the applying roll 31 of the applying unit 30. However, when the surface to be coated 10A of the object to be coated 10 has concavities and convexities, the powder coating material 11 is rarely transferred to a concave portion of the surface to be coated 10A, and thus it is difficult to perform the coating. It is considered that this is because a distance between the applying roll 31 (the surface thereof) and the concave portion (a bottom portion thereof) of the surface to be coated 10A is greater than a distance between the applying roll 31 (the surface thereof) and the convex portion (a top portion thereof) of the surface to be coated 10A, and in a general potential difference, the powder coating material 11 does not sufficiently transferred to the concave portion of the surface to be coated 10A.

In contrast, when the potential difference between the applying roll 31 and the surface to be coated 10A of the object to be coated 10 is excessively increased in order to transfer the powder coating material 11 to the concave portion of the surface to be coated 10A, and thus excessive discharge occurs, and the powder particle layer 11A is scattered due to the discharge.

For this reason, it is currently difficult to form the coating film 12 in the concave portion of the object to be coated 10 having concavities and convexities on the surface to be coated 10A.

Therefore, the powder coating apparatus 101 according to the first exemplary embodiment is provided with the voltage applying device 50 including the voltage applying unit 51 applying the voltage in which the alternating voltage is superimposed with the direct voltage for applying the potential difference between the applying roll 31 and the surface to be coated 10A of the object to be coated 10. For example, the voltage applying unit 51 of the voltage applying device 50 applies the voltage in which the alternating voltage is superimposed with the direct voltage (a negative voltage) to the applying roll 31 (the conductive roll 34 thereof). Accordingly, the potential difference is applied between the applying roll 31 and the surface to be coated 10A of the object to be coated 10, and an alternating electric field is also applied therebetween. When the alternating electric field is applied, among the powder coating materials 11 attached to the surface of the applying rolls 31A and 31B, a powder coating material 11 of which an attachment force with respect to the surface of the applying rolls 31A and 31B is weak starts to vibrate. When the powder coating material 11 vibrates, the powder coating material 11 is repeatedly in contact with and separated from the surrounding powder coating materials 11, the attachment force of the powder coating material 11 which is strongly attached to the surface of the applying rolls 31A and 31B is gradually weakened, and thus the powder coating material 11 starts to vibrate. According to this, the powder coating material 11 is separated from the surface of the applying rolls 31A and 31B, and thus is in a floating state. The powder coating material 11 in the floating state is transferred to the surface to be coated 10A of the object to be coated 10 by the potential difference between the applying roll 31 and the surface to be coated 10A of the object to be coated 10.

Thus, the powder coating material 11 is temporarily separated from the applying roll 31 by the alternating electric field and is in the floating state, and thus even when the potential difference between the applying roll 31 and the surface to be coated 10A of the object to be coated 10 is not excessively increased, the powder coating material 11 is transferred to the concave portion of the object to be coated 10 having concavities and convexities on the surface to be coated 10A. Then, an occurrence of excessive discharge is also prevented.

For this reason, in the powder coating apparatus 101, the coating film is formed in the concave portion of the object to be coated having concavities and convexities on the surface to be coated. Then, in the powder coating apparatus 101, the powder coating material 11 is applied onto a coating surface having concavities and convexities in a state where coating omission (coating unevenness) is prevented.

In addition, the powder coating apparatus 101 according to the first exemplary embodiment includes the electrode plate 70 including the slit 71 between the surface to be coated 10A of the object to be coated 10 and the applying roll 31. Then, the powder coating material 11 attached to the surface of the applying roll 31 is transferred onto the surface to be coated 10A of the object to be coated 10 through the slit 71 of the electrode plate 70. That is, the powder coating material 11 is not transferred onto the surface to be coated 10A of the object to be coated 10 from the applying roll 31 in a region other than the slit 71 of the electrode plate 70. Accordingly, at the time of starting the coating, the powder coating material 11 is not transferred onto the surface to be coated 10A of the object to be coated 10 on the upstream side of the slit 71 of the electrode plate 70 in the transport direction of the object to be coated 10, but the powder coating material 11 starts to be transferred onto the surface to be coated 10A of the object to be coated 10 only in the region of the slit 71 of the electrode plate 70. For this reason, the boundary between the forming portion and the non-forming portion of the coating film which occurs around the time of starting the coating is clarified. Then, when the boundary between the forming portion and the non-forming portion of the coating film is clarified, for example, the visual quality of the coating is improved at the time of forming a coating region and a non-coating region.

In addition, the powder coating apparatus 101 according to the first exemplary embodiment includes the erasing device 80 erasing the surface to be coated 10A of the object to be coated 10 on the upstream side of the applying unit 30 in the transport direction of the object to be coated 10. When the surface to be coated 10A of the object to be coated 10 is erased by the erasing device 80, a difference in a potential gradient is decreased between the concave portion and the convex portion of the object to be coated having concavities and convexities on the surface to be coated. Accordingly, a difference in an attachment state of the powder coating material 11, that is, a difference in the powder particle layer 11A is decreased between the concave portion and the convex portion of the object to be coated. For this reason, the coating film 12 having an approximately homogeneous thickness is formed in both of the concave portion and the convex portion of the object to be coated 10 having concavities and convexities on the surface to be coated 10A.

In particular, as the erasing device 80, a charge erasing type erasing device such as a brush type erasing device, a roll type erasing device, and a corona type erasing device may be applied. This erasing device prevents the concentration of charge attachment on the convex portion of the object to be coated 10 having concavities and convexities on the surface to be coated 10A compared to a charge (ion) applying type erasing device. For this reason, the difference in the potential gradient is decreased between the concave portion and the convex portion of the object to be coated having concavities and convexities on the surface to be coated, and thus the coating film 12 having an approximately homogeneous thickness is easily formed in both of the concave portion and the convex portion of the object to be coated 10.

In addition, in the powder coating apparatus 101 according to the first exemplary embodiment, a speed ratio between the transport speed of the object to be coated 10 and the rotational speed of the applying roll 31 (hereinafter, simply referred to as a "speed ratio" in some cases) may preferably be controlled by the control device 60 such that the thickness of the powder particle layer 11A which is applied onto the surface to be coated 10A of the object to be coated 10 by the applying unit 30 is a predetermined thickness. That is, the transport device 20 (the driving unit thereof) and the applying roll 31 (the driving unit thereof) may preferably be controlled by the control device 60 such that the speed ratio is obtained with which the thickness of the powder particle layer 11A is a predetermined thickness.

This is specifically described as follows.

FIG. 3 is a flowchart illustrating a process executed by the control device 60 of the powder coating apparatus 101 of the first exemplary embodiment. The process executed by the control device 60 of the powder coating apparatus 101 of the first exemplary embodiment is a process of controlling the thickness of the powder particle layer 11A.

Here, a control program of "a process of controlling the thickness of the powder particle layer 11A" is, for example, read from the ROM 60B and executed by the CPU 60A. The control program of "a process of controlling the thickness of the powder particle layer 11A" is started, for example, when a coating instruction or the like is received from the operation display unit 62 or the external device 65 via the communication unit 64. In addition, information acquired during the process is stored in, for example, the RAM 60C which is the work area, and used. However, this is only an example, and the process is not limited thereto.

Figure 4:
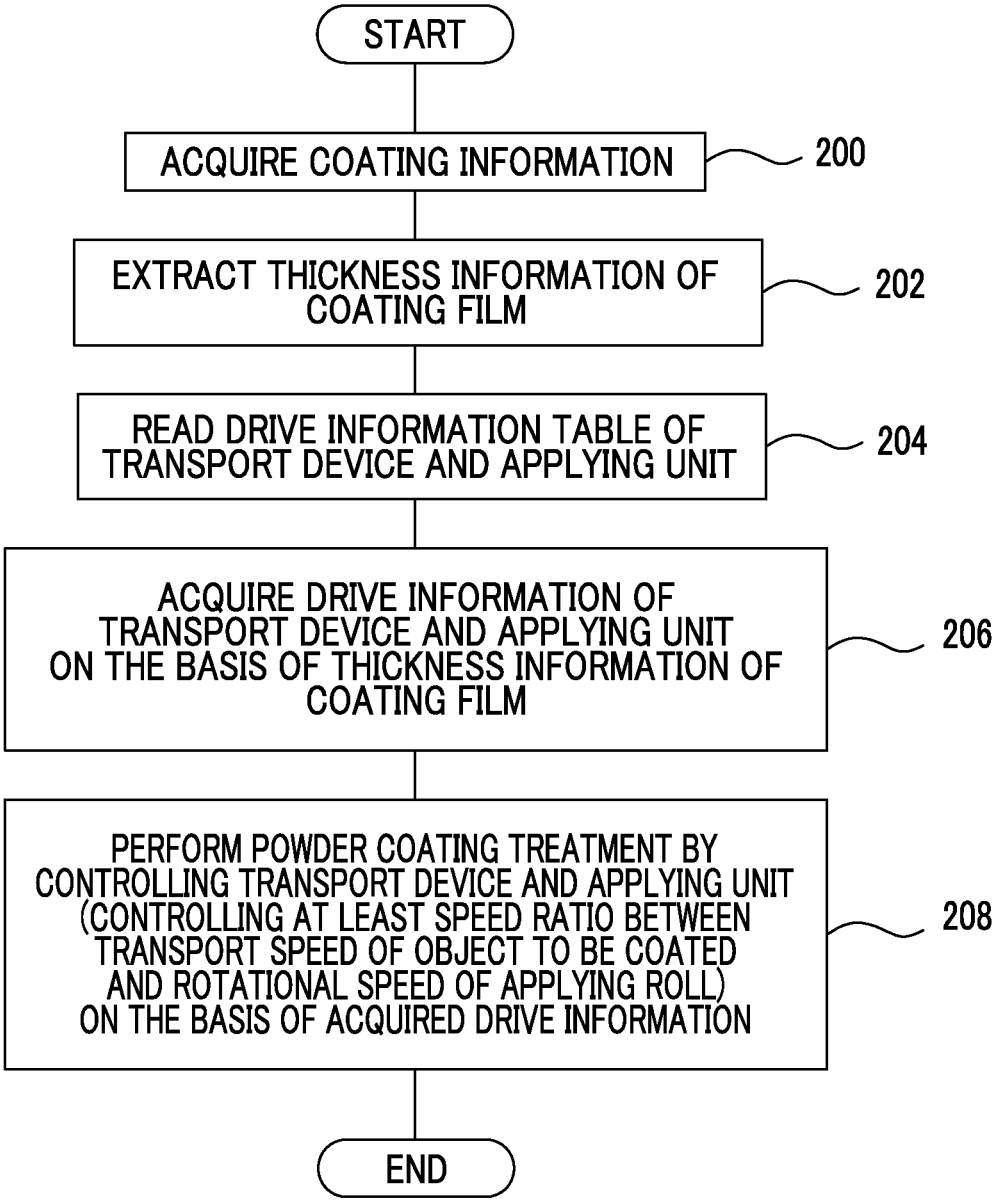
FIG. 4 is a flowchart illustrating an example of processing performed by a control device of the powder coating apparatus according to the first exemplary embodiment.

As illustrated in FIG. 4, first, in Step 200, coating information including the thickness information and the like of the coating film 12 to be formed is acquired.

Next, in Step 202, the thickness information of the coating film 12 is extracted from the coating information.

Next, in Step 204, a drive information table of the transport device 20 and the applying unit 30 is read based on the thickness information of the coating film 12, and the process proceeds to Step 206.

In addition, in Step 206, drive information of the transport device 20 and the applying unit 30 is acquired from the drive information table based on the thickness information of the coating film 12.

Here, the drive information table of the transport device 20 and the applying unit 30 (hereinafter, also referred to as "drive information table") is, for example, stored in advance in the ROM 60B, the non-volatile memory 60D, or the storage unit 63 and used.

The drive information table is, for example, a table in which the thickness information of the coating film 12 is connected to the drive conditions of the transport device 20 and the applying unit 30. Specifically, the drive information table is, for example, a table in which the transport speed of the object to be coated 10 in the transport device 20, the rotational speed of the applying roll 31 in the applying unit 30, the number of times the supplying roll 33 is driven, the number of times the applying unit 30 is driven, and the voltage applied to the supplying roll 33 (the conductive roll 34 thereof) by the voltage applying device 50 are set according to the thickness of the coating film 12. That is, the drive information table is a table in which the speed ratio between the transport speed of the object to be coated 10 and the rotational speed of the applying roll 31, the number of times the supplying roll 33 is driven, the number of times the applying unit 30 is driven, and the potential difference between the supplying roll 33 and the surface to be coated 10A of the object to be coated 10 are set according to the thickness of the coating film 12.

The drive information table is created, for example, as follows. The speed ratio between the transport speed of the object to be coated 10 and the rotational speed of the applying roll 31, the number of times the supplying roll 33 is driven, the number of times the applying unit 30 is driven, and the potential difference between the supplying roll 33 and the surface to be coated 10A of the object to be coated 10 are changed in advance according to the thickness of the coating film 12 to be formed, and the thickness of the coating film 12 (that is, the thickness of the powder particle layer 11A) formed according to the changes is examined. Based on examination, the drive information table is created.

In addition, the drive information table is a table in which the speed ratio between the transport speed of the object to be coated 10 and the rotational speed of the applying roll 31 is set according to the thickness of the coating film 12, and may also be a table in which conditions other than the above conditions are not changed. Furthermore, the drive information table is a table in which the speed ratio between the transport speed of the object to be coated 10 and the rotational speed of the applying roll 31, at least one of the number of times the supplying roll 33 is driven and the number of times the applying unit 30 is driven are set according to the thickness of the coating film 12 to be formed, and may also be a table in which conditions other than the above conditions are not changed.

At least the speed ratio between the transport speed of the object to be coated 10 and the rotational speed of the applying roll 31 is set based on a driving information table prepared in this way. In addition, the number of times of driving of the supplying roll 33, the number of times of driving of the applying unit 30, and the potential difference between the applying roll 31 and the surface to be coated 10A of the object to be coated 10 are also set.

Next, in Step 208, a powder coating treatment is performed by controlling the transport device 20 and the applying unit 30 (that is, controlling at least the speed ratio between the transport speed of the object to be coated 10 and the rotational speed of the applying roll 31) based on the acquired drive information of the transport device 20 and the applying unit 30, and then the routine is ended.

Here, the "powder coating treatment" is a powder coating sequence of performing an application process of applying the powder coating material 11 onto the surface to be coated 10A of the object to be coated 10 by the applying unit 30 and a heating process of heating and thermally curing the powder particle layer 11A applied onto the surface to be coated 10A of the object to be coated 10.

In addition, the powder coating sequence is performed by controlling the speed ratio between the transport speed of the object to be coated 10 and the rotational speed of the applying roll 31 so that the thickness of the powder particle layer 11A applied by the applying unit 30 onto the surface to be coated 10A of the object to be coated 10 becomes a predetermined thickness.

In the first exemplary embodiment, the powder coating sequence is also performed by controlling the number of times the supplying roll 33 is driven, the number of times the applying unit 30 is driven, and the potential difference between the applying roll 31 and the surface to be coated 10A of the object to be coated 10.

Figure 5:
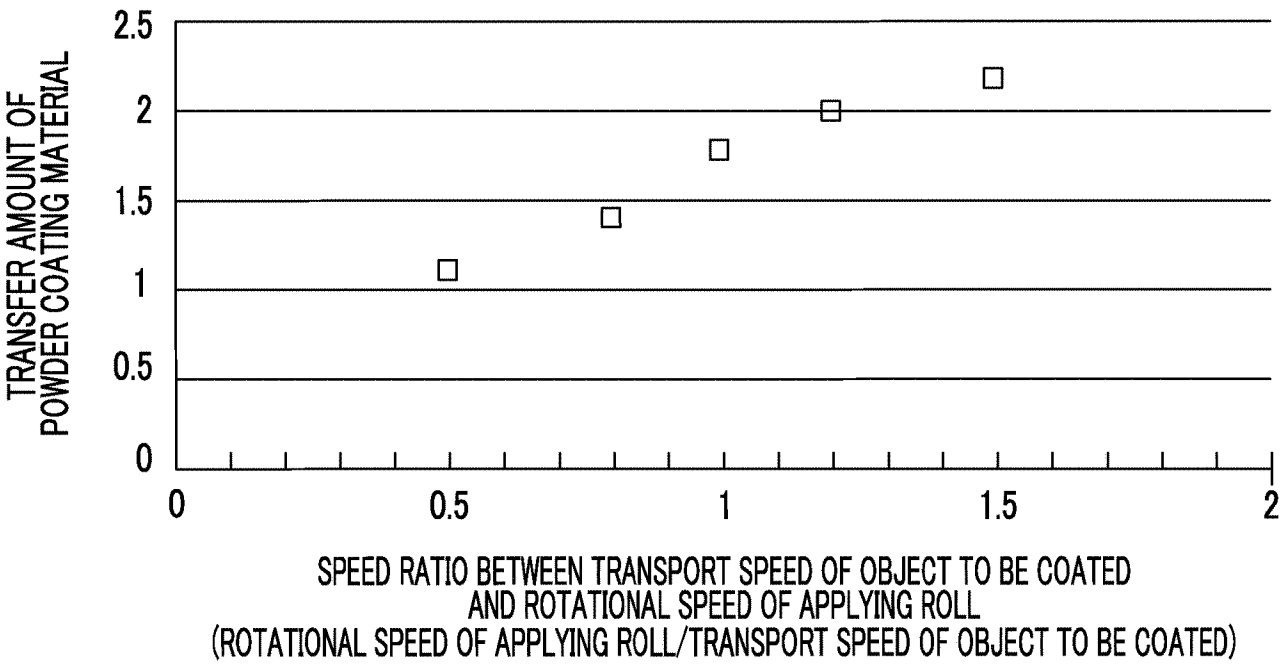
FIG. 5 is a view illustrating the relationship between the speed ratio between the transport speed of an object to be coated and the rotational speed of an applying roll (the rotational speed of the applying roll/the transport speed of the object to be coated) and the transfer amount of a powder coating material transferred from the applying roll to the surface to be coated of the object to be coated.

Here, FIG. 5 illustrates the relationship between the speed ratio between the transport speed of the object to be coated 10 and the rotational speed of the applying roll 31 (the rotational speed of the applying roll 31/the transport speed of the object to be coated 10) and the transfer amount of the powder coating material 11 transferred from the applying roll 31 to the surface to be coated 10A of the object to be coated 10. The relationship is a relationship indicating how much the thickness of the powder particle layer 11A is transferred to the surface to be coated 10A of the object to be coated 10 according to the speed ratio in a state where the powder particle layer 11A having a thickness corresponding to three particles is adhered to the surface of the applying roll 31. That is, a number in the vertical axis of the graph shown in FIG. 5 represents how much the thickness, corresponding to the number of particles, of the powder particle layer 11A is transferred to the surface to be coated 10A of the object to be coated 10.

As illustrated in FIG. 5, it may be seen that, based on the speed ratio between the transport speed of the object to be coated 10 and the rotational speed of the applying roll 31 (the rotational speed of the applying roll 31/the transport speed of the object to be coated 10) as 1, when the speed ratio increases (that is, when the transport speed of the object to be coated 10 is slower than the rotational speed of the applying roll 31), the transfer amount of the powder coating material 11 transferred from the applying roll 31 to the surface to be coated 10A of the object to be coated 10 is increased. On the other hand, it may be seen that, when the speed ratio decreases (that is, when the transport speed of the object to be coated 10 is faster than the rotational speed of the applying roll 31), the transfer amount of the powder coating material 11 transferred from the applying roll 31 to the surface to be coated 10A of the object to be coated 10 is decreased.

In addition, the speed ratio between the transport speed of the object to be coated 10 and the rotational speed of the applying roll 31 (the rotational speed of the applying roll 31/the transport speed of the object to be coated 10) is the speed ratio between the movement speed of the surface to be coated of the object to be coated 10 which is opposed to the surface of the applying roll 31 and the movement speed of the surface of the applying roll 31 which is opposed to the surface to be coated 10A of the object to be coated 10.

As described above, in the powder coating apparatus 101, by controlling the speed ratio, the thickness of the powder particle layer 11A of the powder coating material 11 formed on the surface to be coated 10A of the object to be coated 10 is adjusted. That is, the thickness of the coating film 12 to be formed is adjusted. Therefore, in the powder coating apparatus 101, powder coating is obtained by forming the coating film 12 having a desired thickness with good productivity.

In addition, in the powder coating apparatus 101, the thickness of the powder particle layer 11A is adjusted by the speed ratio described above, and thus even when the potential difference between the applying roll 31 and the surface to be coated 10A of the object to be coated 10 is set to a lower value, the thickness of the powder particle layer 11A increases. When an electric field caused by the potential difference between the applying roll 31 and the surface to be coated 10A of the object to be coated 10 exceeds a Paschen discharge electric field in a gap between the particles of the powder particle layer 11A which is transferred to the coating surface of the object to be coated 10, and dissociation due to the Paschen discharge occurs. At this time, impact and unevenness in the density of charges occur, and thus unevenness in the thickness of the powder particle layer 11A may occur. In contrast, in the powder coating apparatus 101, it is possible to set the potential difference to a lower value, and thus even when the thickness of the powder particle layer 11A (that is, the thickness of the coating film 12) increases, the unevenness in the thickness due to the Paschen discharge is prevented.

In addition, in the powder coating apparatus 101, since the thickness of the powder particle layer 11A is adjusted by the speed ratio, controlling of the thickness of the coating film 12 is easy and stabilized without the use of the resistance of the object to be coated 10, the dielectric properties of the resistive layer of the applying roll 31, the potential difference between the applying roll 31 and the surface to be coated 10A of the object to be coated 10, and the like.

In addition, in the powder coating apparatus 101, the supply of the powder coating material 11 to the applying roll 31 from the supplying roll 33 is performed over the entire surface from one end to the other end of the applying roll 31 in the axial direction. In addition, the powder coating material 11 which adheres to the surface of the applying roll 31 from one end to the other end in the axial direction is transferred and applied onto the surface to be coated 10A of the object to be coated 10. Therefore, the powder coating material 11 is applied to the edge portions of the surface to be coated 10A of the object to be coated 10 in the width direction (edge portions of the object to be coated 10 in a direction intersecting the transport direction thereof). That is, coating of the entire region of the surface to be coated 10A of the object to be coated 10 with the powder coating material 11 is obtained.

In addition, in the powder coating apparatus 101, since the supply of the powder coating material 11 to the applying roll 31 from the supplying roll 33 is performed over the entire surface from one end to the other end of the applying roll 31 in the axial direction, a reduction in the charging amount of the powder coating material 11 is obtained.

Figure 6:
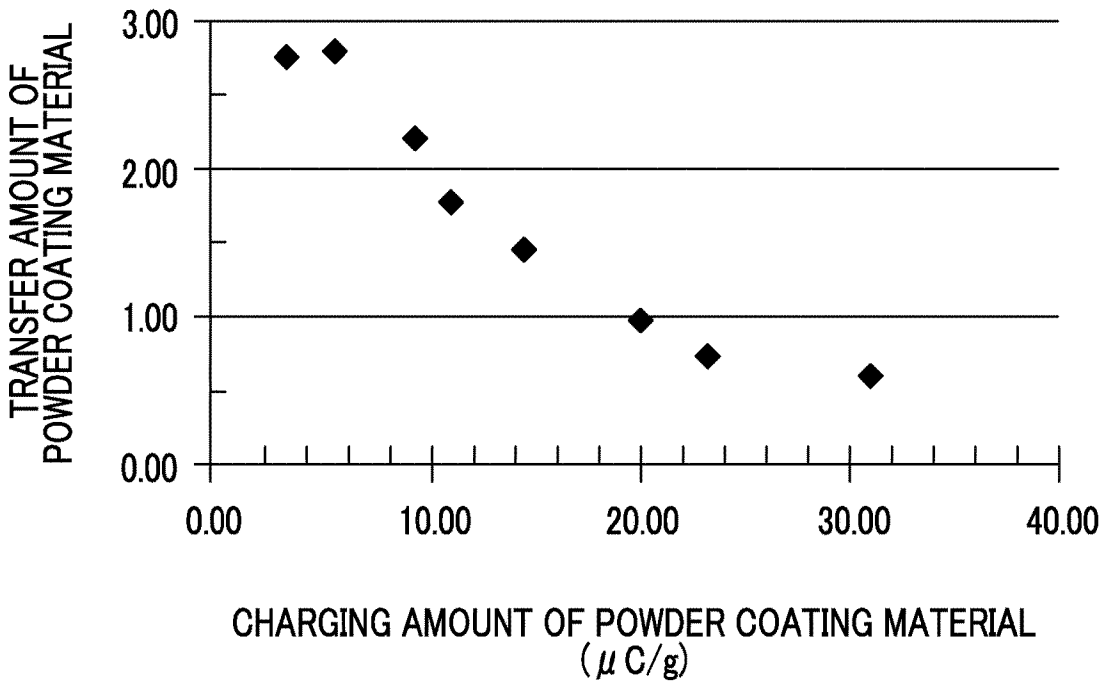
FIG. 6 is a view illustrating the relationship between the charging amount of the powder coating material and the transfer amount of the powder coating material 11 transferred from the applying roll to the surface to be coated of the object to be coated.

Here, FIG. 6 illustrates the relationship between the charging amount of the powder coating material 11 and the transfer amount of the powder coating material 11 transferred from the applying roll 31 to the surface to be coated 10A of the object to be coated 10. The relationship is a relationship indicating how much the thickness of the powder particle layer 11A is transferred to the surface to be coated 10A of the object to be coated 10 according to the charging amount of the powder coating material 11 in a state where the powder particle layer 11A having a thickness corresponding to three particles is adhered to the surface of the applying roll 31. That is, a number in the vertical axis of the graph shown in FIG. 6 represents how much the thickness, corresponding to the number of particles, of the powder particle layer 11A is transferred to the surface to be coated 10A of the object to be coated 10.

As illustrated in FIG. 6, it may be seen that, when the charging amount of the powder coating material 11 is low, the transfer amount of the powder coating material 11 transferred from the applying roll 31 to the surface to be coated 10A of the object to be coated 10 is increased.

As described above, in the powder coating apparatus 101, an increase in the transfer amount of the powder coating material 11 transferred from the applying roll 31 to the surface to be coated 10A of the object to be coated 10 is obtained by decreasing the charging amount of the powder coating material 11. Therefore, in the powder coating apparatus 101, powder coating is obtained by forming the coating film 12 having a desired thickness with good productivity.

In the powder coating apparatus 101 according to the first exemplary embodiment, the supplying sections 32 of the applying unit 30 includes, as the supplying roll 33, plural supplying rolls 33 (in the first exemplary embodiment, the three supplying rolls 33 including the first supplying roll 33, the second supplying roll 33, and the third supplying roll 33) arranged along the circumferential direction of the applying roll 31.

Figure 7:
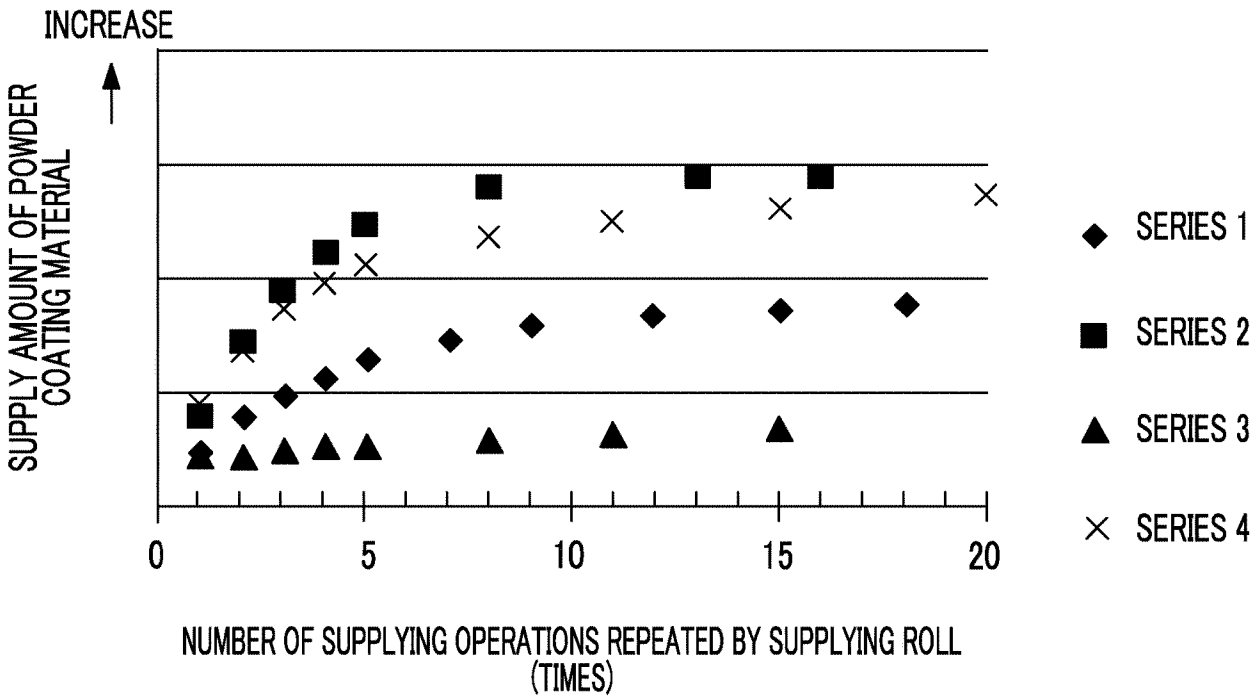
FIG. 7 is a view illustrating the relationship between the number of supplying operations repeated by a single supplying roll and the supply amount of the powder coating material supplied from a supplying roll to the applying roll.

Here, FIG. 7 illustrates the relationship between the number of supplying operations repeated by the single supplying roll 33 and the supply amount of the powder coating material 11 supplied from the supplying roll 33 to the applying roll 31. The relationship is a relationship indicating how much the supply amount of the powder coating material supplied to the applying roll 31 is increased by the number of repeated supplies which is counted assuming that the number of supplying operations by the supplying roll 33 is one when the applying roll 31 rotates once. In addition, FIG. 7 illustrates the relationship measured in Series 1 to Series 4 in which the potential difference between the supplying roll 33 and the applying roll 31, the rotation directions of the supplying roll 33 and the applying roll 31, the ratio between the rotational speeds of the supplying roll 33 and the applying roll 31, and the like are changed.

As illustrated in FIG. 7, it may be seen that, in any of the Series, the supply amount of the powder coating material supplied to the applying roll 31 is increased by repeatedly supplying the powder coating material by the single supplying roll 33. However, it may be seen that the rate of increase in the supply amount of the powder coating material decreases and is saturated when the number of repeated supplies is 5. That is, it may be seen that an increase in the supply amount of the powder coating material 11 supplied from the supplying roll 33 to the applying roll 31 is obtained by increasing the number of supplying rolls 33.

As described above, in the powder coating apparatus 101, by providing the plural supplying rolls 33, the supply amount of the powder coating material 11 supplied from the supplying roll 33 to the applying roll 31 is increased. Therefore, the range of adjustment of the thickness of the powder particle layer 11A with the speed ratio is increased, and thus the degree of freedom of the thickness of the coating film 12 to be formed is increased.

In addition, as illustrated in FIG. 7, the number of supplying rolls 33 is preferably from 2 to 5 in terms of an increase in the supply amount of the powder coating material 11, and is more preferably from 2 to 3 in terms of an increase in the supply amount of the powder coating material 11 and a reduction in the size of the apparatus.

Furthermore, by controlling the number of supplying rolls 33 to be driven among the plural supplying rolls 33 by the control device 60, the adjustment of the amount of the powder coating material 11 that adhere to the applying roll 31 itself is obtained, and thus the degree of freedom of the thickness of the coating film 12 to be formed is increased.

In the powder coating apparatus 101 according to the first exemplary embodiment, as the applying unit 30, the plural applying units 30 (in the first exemplary embodiment, the two applying units 30 including the first applying unit 30 and the second applying unit 30) arranged in the transport direction of the object to be coated 10 are included. By forming the powder particle layers 11A to be overlapped by the plural applying units 30, the thickness of the powder particle layers 11A that may be formed on the coating surface of the object to be coated 10 is increased. Therefore, the degree of freedom of the thickness of the coating film 12 to be formed is increased.

In addition, by controlling the number of applying units 30 to be driven among the plural applying units 30 by the control device 60, the degree of freedom of the thickness of the coating film 12 to be formed is further increased.

Here, as described above, when the charging amount of the powder coating material 11 is low, the transfer amount of the powder coating material 11 transferred from the applying roll 31 to the surface to be coated 10A of the object to be coated 10 is increased (see FIG. 6). However, when the charging amount of the powder coating material 11 is excessively reduced, there is a tendency to increase the number of particles charged to have opposite polarities in the powder coating material 11, and thus it is difficult for the powder coating material 11 to be transferred onto the surface to be coated 10A of the object to be coated 10 from the applying roll 31, resulting in instability in some cases.

Contrary to this, even when the amount of the powder particle layer 11A that may be formed by the single applying unit 30 is reduced by increasing the charging amount of the powder coating material 11, by forming the powder particle layers 11A to be overlapped by the plural applying units 30, the thickness of the powder particle layers 11A that may be formed on the coating surface of the object to be coated 10 is secured.

Therefore, in the powder coating apparatus 101, since the plural applying units 30 are provided, the range of the charging amount of the powder coating material 11 that may be applied is widened, and thus the degree of freedom of the apparatus is increased.

In the powder coating apparatus 101 according to the first exemplary embodiment, when at least one applying unit 30 among the plural applying units 30 is an applying unit which applies the powder coating material 11 having a different color from those of the other applying units 30 onto the surface to be coated 10A of the object to be coated 10, powder coating is obtained by forming the coating film 12 having a desired color.

In the powder coating apparatus 101 according to the first exemplary embodiment, as the heating device 40, the plural heating devices (in the first exemplary embodiment, the two heating devices 40 including the first heating device 40 and the second heating device 40) which respectively heat and thermally cure the powder particle layers 11A applied by the plural applying units 30 onto the surface to be coated 10A of the object to be coated 10 are included. When the powder particle layers 11A respectively formed by the plural applying units 30 are thermally cured, there is no need to consider the Paschen discharge in the powder particle layers 11A after the thermal curing. Therefore, even when the number of applying units 30 is increased, an increase in the thickness of the coating film 12 to be formed is obtained while preventing the thickness unevenness due to the Paschen discharge. As a result, the degree of freedom of the thickness of the coating film 12 to be formed is increased.

Second Exemplary Embodiment

Figure 8:
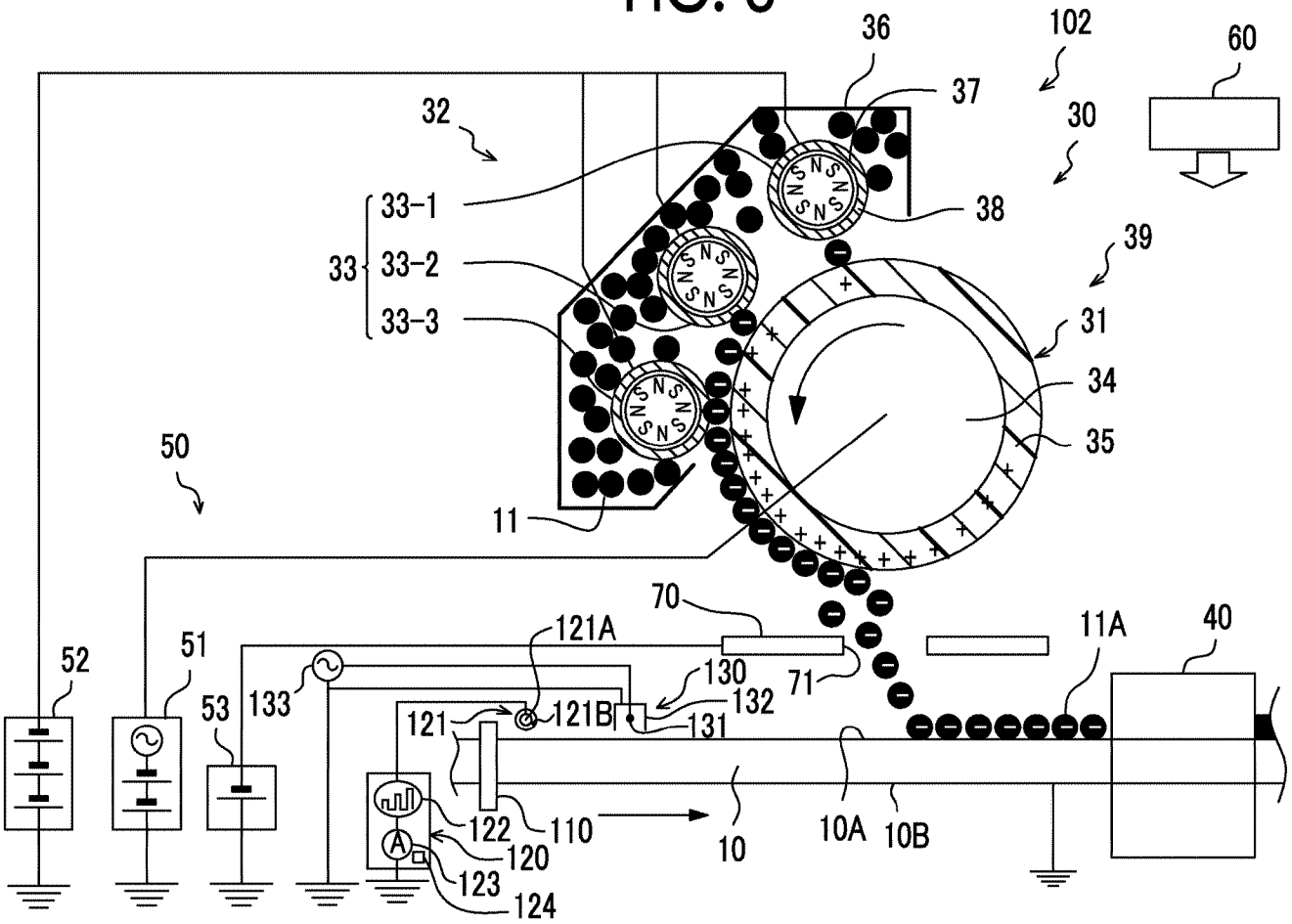
FIG. 8 is a schematic view illustrating an example of a configuration of a powder coating apparatus according to a second exemplary embodiment.

FIG. 8 is a schematic view illustrating an example of a configuration of a powder coating apparatus according to a second exemplary embodiment.

As illustrated in FIG. 8, a powder coating apparatus 102 according to a second exemplary embodiment, for example, includes a height measuring device for a surface to be coated 110 which measures the height of the surface to be coated 10A of the object to be coated 10 from a transport surface 10B on the upstream side of the applying unit 30 in the transport direction of the object to be coated 10, and a discharge voltage measuring device 120 which measures a voltage discharged between a discharge electrode 121 and the surface to be coated 10A of the object to be coated 10 on the upstream side of the applying unit 30 in the transport direction of the object to be coated 10. In addition, the powder coating apparatus 102 also includes an erasing device 130 which erases the surface to be coated 10A of the object to be coated 10 on the upstream side of the applying unit 30 in the transport direction of the object to be coated 10, and on the downstream side of the discharge electrode 121 in the transport direction of the object to be coated 10.

Height Measuring Device for Surface to be Coated

Figure 9:
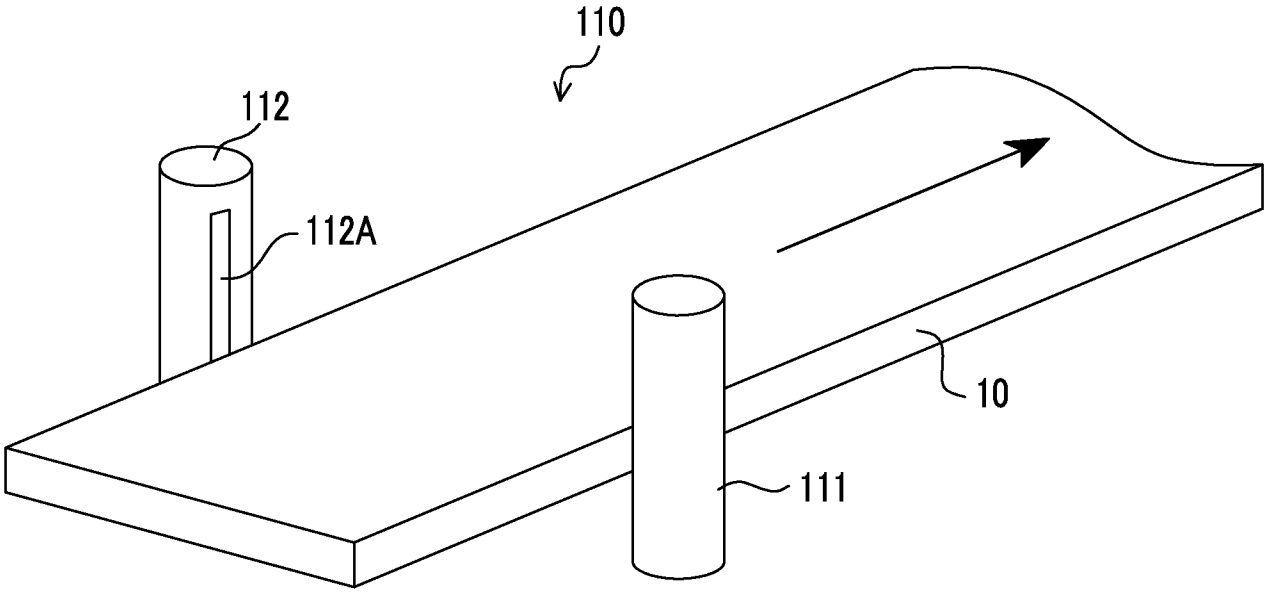
FIG. 9 is a schematic perspective view illustrating an example of a configuration of a height measuring device for a surface to be coated.

As illustrated in FIG. 9, the height measuring device for a surface to be coated 110, for example, includes a columnar light emitting device 111 which is disposed on one end portion side of the object to be coated 10 in a width direction (a direction intersecting with the transport direction), and a columnar light receiving device 112 which is disposed on the other end portion side.

The light emitting device 111, for example, includes a light emitting unit 111A facing a light receiving unit 112A of the light receiving device 112. The light emitting unit 111A includes a light source (not illustrated) emitting light towards the light receiving unit 112A of the light receiving device 112 along the surface to be coated 10A of the object to be coated 10. The light emitting unit 111A has a configuration in which a fluorescent lamp is disposed as the light source. In addition, the light emitting unit 111A also has a configuration in which elements such as a surface light emitting element, a Light Emitting Diode (LED), and a laser light emitting element are arranged side by side in a longitudinal direction of the light emitting unit 111A as the light source. The light emitting unit 111A is arranged to extend up to a position protruding to outside of the object to be coated 10 in a thickness direction from each of a position of the surface to be coated 10A of the object to be coated 10 which is able to be transported (pass) between the light emitting device 111 and the light receiving device 112 and a surface (the transport surface 10B) on a side opposite thereto.

The light receiving device 112, for example, includes the light receiving unit 112A facing the light emitting unit 111A of the light emitting device 111. The light receiving unit 112A has a configuration in which light receiving elements such as a photodiode are arranged side by side in a longitudinal direction of the light receiving unit 112A. The light receiving unit 112A is arranged to extend up to a position protruding to outside of the object to be coated 10 in the thickness direction from each of a position of the surface to be coated 10A of the object to be coated 10 which is able to be transported (pass) between the light emitting device 111 and the light receiving device 112 and the surface (the transport surface 10B) on the side opposite thereto, as with the light emitting unit 111A of the light emitting device 111.

The arrangement position of the height measuring device for a surface to be coated 110 may be on the upstream side of the applying unit 30 (when plural applying units 30 is provided, the entire applying units 30) in the transport direction of the object to be coated 10, or may be on either the upstream side or the downstream side of the discharge voltage measuring device 120 in the transport direction of the object to be coated 10. However, in the second exemplary embodiment, the height measuring device for a surface to be coated 110 is arranged on the upstream side of the discharge voltage measuring device 120 in the transport direction of the object to be coated 10.

Figure 10:
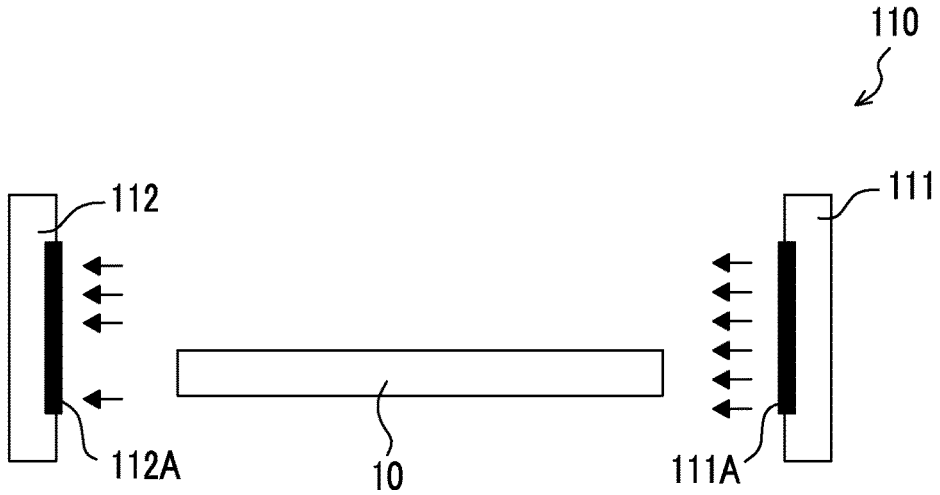
FIG. 10 is a schematic view for illustrating a method of measuring a height of a surface to be coated in the height measuring device for a surface to be coated.

As illustrated in FIG. 10, in the height measuring device for a surface to be coated 110, when the object to be coated 10 is transported (passes) between the light emitting device 111 and the light receiving device 112, light is emitted from the light emitting unit 111A of the light emitting device 111, and the light is received by the light receiving unit 112A of the light receiving device 112. At this time, light blocked by the object to be coated 10 among the light rays emitted from the light emitting unit 111A of the light emitting device 111 is not received by the light receiving unit 112A of the light receiving device 112. In the light receiving unit 112A, the height of the surface to be coated 10A of the object to be coated 10 from the transport surface 10B (the surface of the object to be coated 10 on the side opposite to the surface to be coated 10A) is measured from a region in which the light is received and a region in which the light is not received. That is, the height measuring device for a surface to be coated 110 corresponds to the thickness measuring device for the object to be coated which measure the thickness of the object to be coated 10.

Discharge Voltage Measuring Device

The discharge voltage measuring device 120 includes the discharge electrode 121 which is disposed to be separated from the surface to be coated 10A of the object to be coated 10 on the upstream side of the applying unit 30 in the transport direction of the object to be coated 10. Then, the discharge voltage measuring device 120 includes a voltage applying unit 122 which applies a signal voltage (for example, a pulse voltage or the like) to the discharge electrode 121, an ammeter 123 which detects a current at the time of applying the signal voltage to the discharge electrode 121, and a discharge/non-discharge determination unit 124 which determines whether or not the discharge is performed between the discharge electrode 121 and the surface to be coated 10A of the object to be coated 10 from the current measured by the ammeter 123.

The discharge electrode 121 is configured of a conductive core 121A, and a resistive layer 121B covering the outer surface of the core 121A. The core 121A, for example, is configured of a metal member including metal (aluminum, copper, zinc, chromium, nickel, molybdenum, vanadium, indium, gold, platinum, and the like) or an alloy (stainless steel, an aluminum alloy, and the like). The resistive layer 121B, for example, includes rubber or a resin and a conductive material. Examples of the rubber, for example, include well-known rubbers such as isoprene rubber, chloroprene rubber, and epichlorohydrin rubber. Examples of the resin, for example, include well-known resins such as a polyamide resin, a polyester resin, and a polyimide resin. Examples of the conductive material, for example, include well-known conductive materials such carbon blacks such as ketjen black and acetylene black; metals or alloys such as aluminum and copper; metal oxides such as tin oxide and indium oxide, and the like. Furthermore, each volume resistivity of the resistive layer 121B, for example, is from $10^5$ Ωcm to $10^{10}$ Ωcm (preferably from $10^6$ Ωcm to $10^8$ Ωcm).

In the discharge voltage measuring device 120, when the surface to be coated 10A of the object to be coated 10 passes through a portion facing the discharge electrode 121, for example, a signal voltage having an increasing voltage level (for example, a pulse voltage in a short period of time during which an applying voltage gradually increases to 400 V, 700 V, 1000 V, 1300 V, 1600 V, and 1900 V) is applied to the discharge electrode 121 by the voltage applying unit 122. A current value at this time is detected by the ammeter 123. The discharge/non-discharge determination unit 124 determines whether or not the discharge is performed between the discharge electrode 121 and the surface to be coated 10A of the object to be coated 10 from the detected current value. Then, an applied voltage at the time that the discharge/non-discharge determination unit 124 determines that the discharge is performed is measured (detected) as the discharge voltage. That is, the discharge voltage measuring device 120 measures a discharge start voltage starting the discharge between the discharge electrode 121 and the surface to be coated 10A of the object to be coated 10.

Furthermore, the pulse voltage in a short period of time is applied to the discharge electrode 121 as the signal voltage, and thus even when the object to be coated 10 is small, the measurement ends within a time during which the object to be coated 10 passes through the portion facing the discharge electrode 121. In addition, an influence of a discharged charge on the surface to be coated 10A of the object to be coated 10 decreases.

Erasing Device

The erasing device 130, for example, includes a discharge wire 131, and a shield 132 which surrounds the discharge wire 131 except for a side of the discharge wire 131 facing the surface to be coated 10A of the object to be coated 10. The erasing device 130 also includes a voltage applying unit 133 applying an alternating voltage to the discharge wire 131. Furthermore, the shield 132 is in a grounded state.

In the erasing device 130, a voltage is applied from the voltage applying unit 133, and corona discharge is made to occur from the discharge wire, and thus the erasing is performed.

The erasing device 130 is not limited to a corona discharge type erasing device using the discharge wire. Examples of the erasing device 130 include a roll type contact erasing device using an erasing brush and an erasing roll; a non-contact erasing device using corona discharge or a soft X-ray, and the like.

Furthermore, the erasing device 130 is a device which is disposed in the powder coating apparatus 102, as necessary.

Operation of Powder Coating Apparatus

Next, an example of the operation of the powder coating apparatus 102 according to the second exemplary embodiment will be described. Furthermore, the operation of the powder coating apparatus 102 is performed by various programs executed in the control device 60.

In the powder coating apparatus 102, when the object to be coated 10 is transported by the transport device 20, and the coating starts, the height measuring device for a surface to be coated 110 measures the height of the surface to be coated 10A of the object to be coated 10 (that is, the thickness of the object to be coated 10) from the transport surface 10B (the surface of the object to be coated 10 on the side opposite to the surface to be coated 10A) at the time that the object to be coated 10 passes through the height measuring device for a surface to be coated 110.

Next, when the object to be coated 10 passes through the portion of the discharge voltage measuring device 120 facing the discharge electrode, the discharge voltage measuring device 120 measures a voltage (that is, the discharge start voltage) discharged between the discharge electrode 121 and the surface to be coated 10A of the object to be coated 10.

Then, in the control device 60, the amplitude of the alternating voltage of the voltage applying unit 51 which applies a voltage to the applying roll 31 is determined based on a measurement value (the height of the surface to be coated 10A of the object to be coated 10 from the transport surface 10B) obtained by the height measuring device for a surface to be coated 110 and a measurement value (the voltage discharged between the discharge electrode 121 and the surface to be coated 10A of the object to be coated 10) obtained by the discharge voltage measuring device 120.

Specifically, for example, the amplitude of the alternating voltage of the voltage applying unit 51 which applies a voltage to the applying roll 31 is determined as follows.

Figure 11:
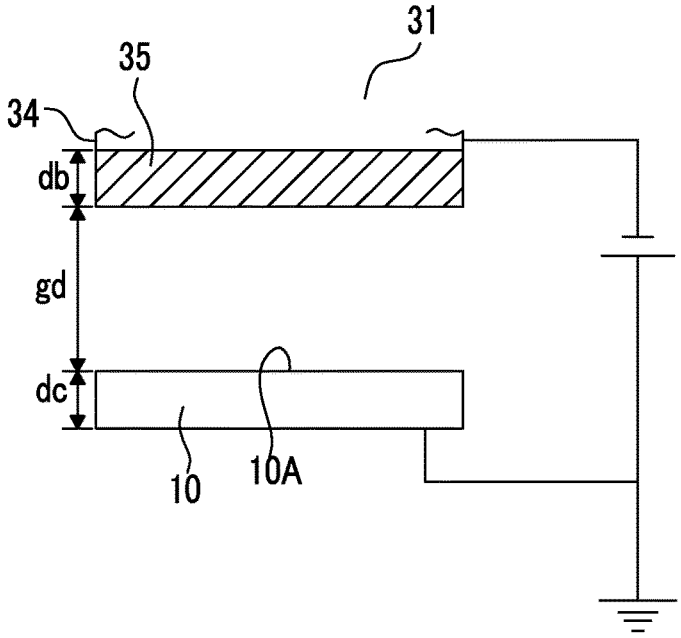
FIG. 11 is a schematic view illustrating a powder coating material applying unit applying a powder coating material to the surface to be coated of the object to be coated from an applying roll of the applying unit.

First, when a powder coating material applying unit applying the powder coating material to the surface to be coated of the object to be coated from the applying roll of the applying unit 30 is considered as a model illustrated in a schematic view of FIG. 11, the discharge which occurs between the applying roll 31 and the surface to be coated 10A of the object to be coated 10 follows the Paschen's law. For this reason, a discharge voltage Vd at which the discharge occurs between the applying roll 31 and the surface to be coated 10A of the object to be coated 10 is denoted by the following expression.

$$Vd=(db/\in b+gd+dc/\in c)/gd\cdot(312+6.2gd) \qquad \text{Expression:}$$

(In the expression, db represents the thickness of the resistive layer 35 of the applying roll 31. ∈b represents a dielectric constant of the resistive layer 35 of the applying roll 31. dc represents the thickness of the object to be coated 10. ∈c represents a dielectric constant of the object to be coated 10. gd represents a facing distance between an outer circumferential surface of the resistive layer 35 of the applying roll 31 and the surface to be coated 10A of the object to be coated 10.)

Figure 12:
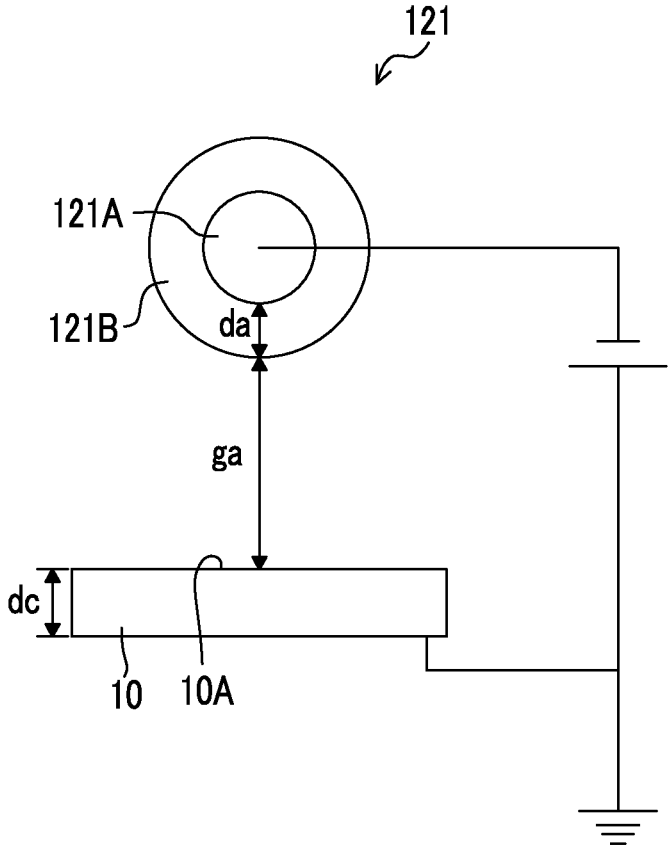
FIG. 12 is a schematic view illustrating a discharge voltage measurement unit of a discharge voltage measuring device.

On the other hand, when a discharge voltage measurement unit of the discharge voltage measuring device 120 is considered as a model illustrated in a schematic view of FIG. 12, the discharge which occurs between the discharge electrode 121 and the surface to be coated 10A also follows to the Paschen's law. For this reason, a discharge voltage Va at which the discharge occurs between the discharge electrode 121 and the surface to be coated 10A is denoted by the following expression.

$$Va=(da/\in a+ga+dc/\in c)/ga\cdot(312+6.2ga) \qquad \text{Expression;}$$

(In the expression, da represents the thickness of the resistive layer 121B of the discharge electrode 121. ∈a represents a dielectric constant of the resistive layer 121B of the discharge electrode 121. dc represents the thickness of the object to be coated 10. ∈c represents a dielectric constant of the object to be coated 10. ga represents a facing distance between an outer circumferential surface of the resistive layer 121B of the discharge electrode 121 and the surface to be coated 10A of the object to be coated 10.)

Accordingly, in the powder coating material applying unit, the discharge voltage Vd at which the discharge occurs between the applying roll 31 and the surface to be coated 10A of the object to be coated 10 is calculated by the following expression.

$$Vd=Va(db/\in b+gd+dc/\in c)/(da/\in a+ga+dc/\in c) \qquad \text{Expression:}$$

In the expression described above which calculates the discharge voltage Vd, the thickness db of the resistive layer 35 of the applying roll 31, the dielectric constant ∈b of the resistive layer 35 of the applying roll 31, the thickness da of the resistive layer 121B of the discharge electrode 121, the dielectric constant ∈a of the resistive layer 121B of the discharge electrode 121, and the facing distance ga between the outer circumferential surface of the resistive layer 121B of the discharge electrode 121 and the surface to be coated 10A of the object to be coated 10 are able to be measured or set in advance.

On the other hand, the thickness dc of the object to be coated 10 is measured by the height measuring device for a surface to be coated 110. Then, the facing distance between the transport surface 10B of the object to be coated 10 and the outer circumferential surface of the resistive layer 35 of the applying roll 31 is able to be set in advance, and thus the facing distance gd between the outer circumferential surface of the resistive layer 35 of the applying roll 31 and the surface to be coated 10A of the object to be coated 10 is calculated from the measured thickness dc of the object to be coated 10.

Further, the discharge voltage Va at which the discharge occurs between the discharge electrode 121 and the surface to be coated 10A is measured by the discharge voltage measuring device 120. Then, the dielectric constant ∈c of the object to be coated 10 is calculated from the measured discharge voltage Va (refer to the calculation expression of Va described above).

Thus, in the control device 60, the discharge voltage Vd at which the discharge occurs between the applying roll 31 and the surface to be coated 10A of the object to be coated 10 is calculated based on the measurement value (the height of the surface to be coated 10A of the object to be coated 10 from the transport surface 10B) obtained by the height measuring device for a surface to be coated 110 and the measurement value (the voltage discharged between the discharge electrode 121 and the surface to be coated 10A of the object to be coated 10) obtained by the discharge voltage measuring device 120. Then, it is determined that the amplitude of the alternating voltage of the voltage applying unit 51 which applies a voltage to the applying roll 31, for example, is less than the discharge voltage Vd, or less than the discharge voltage Vd×0.95.

Furthermore, the powder particles of the powder coating material 11 are actually charged and affect the entire electric field, and thus a value obtained by further adding a buffer voltage to the discharge voltage Vd calculated in advance may be the discharge voltage at which the discharge occurs between the applying roll 31 and the surface to be coated 10A of the object to be coated 10. The degree of the buffer voltage may be obtained by adding the element of the powder particles of the powder coating material 11 to the calculation expression described above, and may be obtained by measuring a surface potential of the powder particle layer 11A using a surface electrometer.

Then, in the powder coating apparatus 102, the voltage applying unit 51 is controlled by the control device 60 such that the voltage is applied in which the determined alternating voltage is superimposed with the direct voltage for applying a potential difference between the applying roll 31 and the surface to be coated 10A of the object to be coated 10. Accordingly, in a state where the occurrence of the discharge is prevented, the voltage is supplied to the surface to be coated 10A of the object to be coated 10 from the applying roll 31. For this reason, the powder particle layer 11A is prevented from being scattered due to the discharge, and thus the coating film 12 having an approximately homogeneous thickness is formed.

In addition, in the powder coating apparatus 102, the discharged charge which is attached to the surface to be coated 10A of the object to be coated 10 due to the discharge occurring from the discharge electrode 121 of the discharge voltage measuring device 120 is erased by the erasing device 130. For this reason, the powder particle layer 11A is prevented from being scattered due to the discharged charge, and thus the coating film 12 having an approximately homogeneous thickness is formed.

Powder Coating Material

Hereinafter, a preferable thermosetting powder coating material 11 used in the powder coating apparatuses 101 and 102 according to the first and second exemplary embodiments will be described. Furthermore, the preferable thermosetting powder coating material 11 will be described by being referred to a powder coating material according to this exemplary embodiment in which the reference numeral is omitted.

The powder coating material according to this exemplary embodiment includes powder particles having a core containing a thermosetting resin and a thermal curing agent and a resin coating portion which coats the surface of the core.

In addition, the volume-based particle size distribution index GSDv of the powder particles is equal to or less than 1.50 and the average circularity of the powder particles is equal to or higher than 0.96.

The powder coating material according to this exemplary embodiment may be any of a transparent powder coating material (clear coating material) that does not contain a colorant in the powder particles and a colored powder coating material which contains a colorant in the powder particles.

With the above configuration, even when the powder particles are reduced in diameter, the powder coating material according to this exemplary embodiment forms a coating film having high smoothness with a small amount of the material and has high storage properties. Although the reason is not clear, it is assumed that this is due to the following reasons.

First, in recent years, during the coating of a powder coating material, forming a thin coating film with a small amount of powder coating material is required. For this, there is a need to reduce the diameter of the powder particles of the powder coating material. However, when the diameter of the powder particles is simply reduced by a kneading and pulverizing method or the like, fine powder is prepared, and thus the particle size distribution widens, resulting in a state where coarse powder and fine powder are increased in amount. In addition, the powder particles are likely to have irregular shapes.

As a result of the increase in the amount of coarse powder in the powder particles, uneven portions are formed on the surface of the coating film due to the coarse powder, and thus a coating film having a low smoothness is likely to be formed. When there is a large amount of fine powder in the powder particles, the fluidity of the powder particles is reduced, and aggregates of the powder particles are easily formed. Therefore, a coating film having a low smoothness is likely to be formed. When the powder particles have irregular shapes, the fluidity of the powder particles is reduced, and aggregation (blocking) of the powder particles easily occurs. Therefore, a coating film having a low smoothness is likely to be formed. Furthermore, when the powder particles have irregular shapes, voids are more likely to be provided between the powder particles during the adhesion of the powder particles to a surface to be coated. As a result, uneven portions are formed on the surface of the coating film after heating, and thus a coating film having a low smoothness is likely to be formed.

Here, the volume-based particle size distribution index GSDv of the powder particles is set to be equal to or less than 1.50. That is, by narrowing the particle size distribution of the powder particles, a state in which the amounts of coarse powder and fine powder are small is achieved. Accordingly, even when the diameter of the powder particles is reduced, a reduction in the fluidity and the occurrence of aggregation (blocking) of the powder particles are prevented.

In addition, the average circularity of the powder particles is set to be equal to or higher than 0.96 such that the shapes of the powder particles are similar to spherical shapes. That is, even when the diameter of the powder particles is reduced, a reduction in the fluidity is prevented. In addition, by reducing the contact area between the powder particles, a state in which voids between the powder particles are reduced in size is achieved when the powder particles adhere to the surface to be coated.

On the other hand, when the diameter of the powder particles is reduced, the distance from the inside to the surface of the powder particle is reduced. Therefore, a phenomenon in which inclusions (the thermal curing agent, and additives added in addition to the thermal curing agent as necessary, such as the colorant, a leveling agent, and a flame retardant) in the powder particles precipitate (hereinafter, also called "bleed") may easily occur with time. When the bleed occurs, aggregation (blocking) of the powder particles occurs, resulting in the degradation in storage efficiency.

Here, as the powder particles, particles are applied in which a particle containing the thermosetting resin and the thermal curing agent (that is, a particle that functions as the powder coating material) is the core and the resin coating portion is formed on the surface of the core. When the powder particles having the layer configuration are applied, the resin coating portion acts as a barrier and thus the bleed of inclusions contained in the core such as the thermal curing agent to the surface of the powder particles is prevented.

For the above reason, it is assumed that the powder coating material according to this exemplary embodiment forms a coating film having high smoothness with a small amount of the material and has high storage efficiency even when the powder particles are reduced in diameter.

In addition, since the coating film having high smoothness is formed with a small amount of the powder coating material even when the powder particles are reduced in diameter, the powder coating material according to this exemplary embodiment also enhances the glossiness of the obtained coating film.

Furthermore, since the powder coating material according to this exemplary embodiment has high storage properties, even when the powder coating material that does not adhere to the surface to be coated is reused after powder coating, similarly, the formation of a coating film having high smoothness with a small amount of the material is obtained. Therefore, the powder coating material according to this exemplary embodiment also has high durability. In addition, since the powder coating material according to this exemplary embodiment has high fluidity, transport efficiency and coating efficiency are high and coating workability is excellent.

In JP-A-2001-106959, "spherical thermosetting powder clear coating material particles containing an acrylic resin A and an acrylic resin B, in which (a) (an SP value of the acrylic resin A)–(an SP value of the acrylic resin B) is 0.5 to 1.5 and the ratio of an average particle size to a number-average particle size is equal to or less than 2" are disclosed. However, a resin coating portion which acts as the barrier is not clearly formed on the surface portion of the coating material particles, and when the diameter of the coating material particles is reduced, the bleed of inclusions thereof easily occurs under present circumstances. In JP-A-2005-211900, "a powder coating method including a process of coating a conductive surface or a layer on the surface with powder to form a coating on the surface or the layer, in which the powder is prepared by aggregation and coalescence of particles in an aqueous dispersoid, and the particles contain resin particles" are disclosed. However, similarly, a resin coating portion which acts as the barrier is not clearly formed on the surface portion of the powder (particle), and when the diameter of the coating material powder is reduced, the bleed of inclusions thereof easily occurs under present circumstances. Therefore, the powder coating material according to this exemplary embodiment is preferable for the above reasons.

Hereinafter, the details of the powder coating material according to this exemplary embodiment will be described.

The powder coating material according to this exemplary embodiment includes powder particles. The powder coating material may also include an external additive that adheres to the surface of the powder particles as necessary in terms of an increase in fluidity.

Powder Particles

The powder particles have the core and the resin coating portion that adheres to the surface of the core. That is, the powder particles have a core-shell structure.

Properties of Powder Particles

The volume-based particle size distribution index GSDv of the powder particles is equal to or less than 1.50, preferably equal to or less than 1.40 in terms of the smoothness of the coating film and the storage properties of the powder coating material, and even more preferably equal to or less than 1.30.

The volume-average particle size D50v of the powder particles is preferably from 1 μm to 25 μm in terms of the formation of a coating film having high smoothness with a small amount of materials, more preferably from 2 μm to 20 μm, and even more preferably from 3 μm to 15 μm.

The average circularity of the powder particles is equal to or higher than 0.96, preferably equal to or higher than 0.97 in terms of the smoothness of the coating film and the storage properties of the powder coating material, and even more preferably equal to or higher than 0.98.

Here, the volume-average particle size D50v and the volume-based particle size distribution index GSDv of the powder particles are measured by using the Coulter Multisizer II (manufactured by Beckman Coulter, Inc.), and using the Isoton II (manufactured by Beckman Coulter, Inc.) as an electrolytic solution.

During the measurement, as a dispersant, 0.5 mg to 50 mg of a measurement sample is added to 2 ml of a 5% aqueous solution of a surfactant (preferably sodium alkylbenzene sulfonate). This is added to 100 ml to 150 ml of the electrolytic solution.

The electrolytic solution in which the sample is suspended is subjected to a dispersion treatment for 1 minute by an ultrasonic dispersing unit, and a particle size distribution of particles having a diameter in a range of from 2 μm to 60 μm is measured by Coulter Multisizer II, using a 100-μm aperture as an aperture diameter. In addition, the number of sampled particles is 50,000.

A cumulative distribution of volumes is drawn from a small diameter side with respect to particle size ranges (channels) divided based on the measured particle size distribution. A particle size which corresponding to cumulative 16% is defined as a volume-based particle size D16v, a particle size corresponding to cumulative 50% is defined as a volume-average particle size D50v, and a particle size corresponding to cumulative 84% is defined as a volume-based particle size D84v.

In addition, the volume-average particle size distribution index (GSDv) is calculated as $(D84v/D16v)^{1/2}$.

The average circularity of the powder particles is measured by using a flow type particle image analyzer "FPIA-3000 (manufactured by Sysmex Corporation)". Specifically, 0.1 ml to 0.5 ml of a surfactant (alkyl benzene sulfonate) as a dispersant is added to 100 ml to 150 ml of water from which solid impurities are removed in advance, and 0.1 g to 0.5 g of the measurement sample is further added thereto. A suspension in which the measurement sample is dispersed is subjected to the dispersion treatment for from 1 minute to 3 minutes by the ultrasonic dispersing unit so that the dispersion concentration is from 3000 pieces/μl to 10,000 pieces/μl. For the dispersion, the average circularity of the powder particles is measured by using the flow type particle image analyzer.

Here, the average circularity of the powder particles is a value is calculated by obtaining the circularity (Ci) of each of n particles measured among the powder particles and then using the following equation. Here, in the following equation, Ci represents the circularity (=the perimeter of a circle equivalent to the projected area of particle/the perimeter of a projected image of particle), and fi represents the frequency of the powder particles.

$$\text{Average Circularity}(Ca) = \left(\sum_{i=1}^{n} (Ci \times fi)\right) / \sum_{i=1}^{n} (fi)$$

Core

The core contains the thermosetting resin and the thermal curing agent. The core may also contain the other additives such as colorants as necessary.

Curable Resin

The thermosetting resin is a resin having a thermosetting reactive group. As the thermosetting resin, hitherto, various types of resins used for powder particles of a powder coating material may be employed.

The thermosetting resin may preferably be a water-insoluble (hydrophobic) resin. When the water-insoluble (hydrophobic) resin is applied as the thermosetting resin, the environmental dependence of the charging properties of the powder coating material (powder particles) is reduced. In addition, in a case where the powder particles are prepared by an aggregation and coalescence method, the thermosetting resin may preferably be a water-insoluble (hydrophobic) resin in terms of the realization of emulsion dispersion in an aqueous medium. Water insolubility (hydrophobicity) means that the amount of a dissolved object material with respect to 100 parts by weight of water at 25° C. is less than 5 parts by weight.

Among the thermosetting resins, at least one type selected from the group consisting of a thermosetting (meth)acrylic resin and a thermosetting polyester resin is preferable.

Thermosetting (Meth)Acrylic Resin

The thermosetting (meth)acrylic resin is a (meth)acrylic resin having a thermosetting reactive group. For the introduction of the thermosetting reactive group to the thermosetting (meth)acrylic resin, a vinyl monomer having a thermosetting reactive group may be used. The vinyl monomer having a thermosetting reactive group may be a (meth) acrylic monomer (a monomer having a (meth)acryloyl group) and may also be a vinyl monomer other than the (meth)acrylic monomer.

Here, examples of the thermosetting reactive group of the thermosetting (meth)acrylic resin include an epoxy group, a carboxyl group, a hydroxyl group, an amide group, an amino group, an acid anhydride group, and a (blocked) isocyanate group. Among these, as the thermosetting reactive group of the (meth)acrylic resin, at least one type selected from the group consisting of an epoxy group, a carboxyl group, and a hydroxyl group is preferable in terms of ease of the manufacture of the (meth)acrylic resin. Particularly, in terms of excellent storage stability of the powder coating material and the appearance of the coating film, it is more preferable that at least one type of the curing reactive group is an epoxy group.

Examples of the vinyl monomer having an epoxy group as the thermosetting reactive group include various types of chain epoxy group-containing monomers (for example, glycidyl (meth)acrylate, β-methyl glycidyl (meth)acrylate, glycidyl vinyl ether, and allyl glycidyl ether), various types of (2-oxo-1,3-oxolane) group-containing vinyl monomers (for example, (2-oxo-1,3-oxolane)methyl (meth)acrylate), various types of alicyclic epoxy group-containing vinyl monomers (for example, 3,4-epoxycyclohexyl (meth)acrylate, 3,4-epoxycyclohexylmethyl (meth)acrylate, and 3,4-epoxycyclohexylethyl (meth)acrylate).

Examples of the vinyl monomer having an carboxyl group as the thermosetting reactive group include various types of carboxyl group-containing monomers (for example, (meth) acrylic acid, crotonic acid, itaconic acid, maleic acid, and fumaric acid), various types of monoesters of an α,β-unsaturated dicarboxylic acid and a monohydroxy alcohol having from 1 to 18 carbon atoms (for example, monomethyl fumarate, monoethyl fumarate, monobutyl fumarate, monoisobutyl fumarate, mono-tert-butyl fumarate, monohexyl fumarate, monooctyl fumarate, mono-2-ethylhexyl fumarate, monomethyl maleate, monoethyl maleate, monobutyl maleate, monoisobutyl maleate, mono-tert-butyl maleate, monohexyl maleate, monooctyl maleate, and mono-2-ethylhexyl maleate), and itaconic acid monoalkyl esters (for example, monomethyl itaconate, monoethyl itaconate, monobutyl itaconate, monoisobutyl itaconate, monohexyl itaconate, monooctyl itaconate, and mono-2-ethylhexyl itaconate).

Examples of the vinyl monomer having an hydroxyl group as the thermosetting reactive group include various types of hydroxyl group-containing (meth)acrylates (for example, 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, polyethylene glycol mono (meth)acrylate, and polypropylene glycol mono(meth)acrylate), addition reaction products of the above-mentioned various types of hydroxyl group-containing (meth)acrylates and ε-caprolactone, various types of hydroxyl group-containing vinyl ethers (for example, 2-hydroxyethyl vinyl ether, 3-hydroxypropyl vinyl ether, 2-hydroxypropyl vinyl ether, 4-hydroxybutyl vinyl ether, 3-hydroxybutyl vinyl ether, 2-hydroxy-2-methylpropyl vinyl ether, 5-hydroxypentyl vinyl ether, and 6-hydroxyhexyl vinyl ether), addition reaction products of the above-mentioned various types of hydroxyl group-containing vinyl ethers and ε-caprolactone, various types of hydroxyl group-containing allyl ethers (for example, 2-hydroxyethyl (meth)allyl ether, 3-hydroxypropyl (meth)allyl ether, 2-hydroxypropyl (meth)allyl ether, 4-hydroxybutyl (meth)allyl ether, 3-hydroxybutyl (meth) allyl ether, 2-hydroxy-2-(meth)ylpropyl (meth)allyl ether, 5-hydroxypentyl (meth)allyl ether, and 6-hydroxyhexyl (meth)allyl ether), and addition reaction products of the above-mentioned various types of hydroxyl group-containing allyl ethers and ε-caprolactone.

The thermosetting (meth)acrylic resin may also be made through copolymerization with another vinyl monomer that does not have a curing reactive group, other than the (meth)acrylic monomer.

Examples of the vinyl monomer include various types of α-olefins (for example, ethylene, propylene, and butene-1), various types of halogenated olefins excluding fluoroolefin (for example, vinyl chloride, and vinylidene chloride), various types of aromatic vinyl monomers (for example, styrene, α-methylstyrene, and vinyl toluene), various types of diesters of an unsaturated dicarboxylic acid and a monohydroxy alcohol having from 1 to 18 carbon atoms (for example, dimethyl fumarate, diethyl fumarate, dibutyl fumarate, dioctyl fumarate, dimethyl maleate, diethyl maleate, dibutyl maleate, dioctyl maleate, dimethyl itaconate, diethyl itaconate, dibutyl itaconate, and dioctyl itaconate), various types of acid anhydride group-containing monomers (for example, maleic anhydride, itaconic anhydride, citraconic anhydride, (meth)acrylic anhydride, and tetrahydrophthalic anhydride), various types of phosphoric acid ester group-containing monomers (for example, diethyl-2-(meth)acryloyloxyethyl phosphate, dibutyl-2-(meth)acryloyloxybutyl phosphate, dioctyl-2-(meth)acryloyloxyethyl phosphate, and diphenyl-2-(meth)acryloyloxyethyl phosphate), various types of hydrolyzable silyl group-containing monomers (for example, γ-(meth) acryloyloxypropyltrimethoxysilane, γ-(meth) acryloyloxypropyltriethoxysilane, and γ-(meth) acryloyloxypropylmethyldimethoxysilane), various types of aliphatic vinyl carboxylates (for example, vinyl acetate, vinyl propionate, vinyl butyrate, vinyl isobutyrate, vinyl caproate, vinyl caprylate, vinyl caprate, vinyl laurate, branched aliphatic vinyl carboxylates having from 9 to 11 carbon atoms, and vinyl stearate), various types of carboxylic acid vinyl esters having a cyclic structure (for example, vinyl cyclohexanecarboxylate, vinyl methylcyclohexanecarboxylate, vinyl benzoate, and vinyl p-tert-butylbenzoate).

In addition, in the thermosetting (meth)acrylic resin, in a case where a vinyl monomer other than the (meth)acrylic monomer is used as the vinyl monomer having a thermosetting reactive group, an acrylic monomer which does not have a thermosetting reactive group is used.

Examples of the acrylic monomer which does not have a thermosetting reactive group include (meth)acrylic acid alkyl esters (for example, methyl (meth)acrylate, ethyl (meth)acrylate, n-propyl (meth)acrylate, isopropyl (meth) acrylate, n-butyl (meth)acrylate, isobutyl (meth)acrylate, tert-butyl (meth)acrylate, n-hexyl (meth)acrylate, cyclohexyl (meth)acrylate, 2-ethylhexyl (meth)acrylate, n-octyl (meth)acrylate, isooctyl (meth)acrylate, 2-ethyloctyl (meth) acrylate, dodecyl (meth)acrylate, isodecyl (meth)acrylate, lauryl (meth)acrylate, and stearyl (meth)acrylate), various types of (meth)acrylic acid aryl esters (for example, benzyl (meth)acrylate, phenyl (meth)acrylate, and phenoxy ethyl (meth)acrylate), various types of alkyl carbitol (meth)acrylates (for example, ethyl carbitol (meth)acrylate), other various types of (meth)acrylic acid esters (for example, isobornyl (meth)acrylate, dicyclopentanyl (meth)acrylate, dicyclopentenyl (meth)acrylate, dicyclopentenyloxyethyl (meth)acrylate, and tetrahydrofurfuryl (meth)acrylate), various types of amino group-containing amide-based unsaturated monomers (for example, N-dimethylaminoethyl (meth)acrylamide, N-diethylaminoethyl (meth)acrylamide, N-dimethylaminopropyl (meth)acrylamide, and N-diethylaminopropyl (meth)acrylamide), various types of dialkylaminoalkyl (meth)acrylates (for example, dimethylaminoethyl (meth)acrylate and diethylaminoethyl (meth)acrylate), various types of amino group-containing monomers (for example, tert-butylaminoethyl (meth)acrylate, tert-butylaminopropyl (meth)acrylate, aziridinyl ethyl (meth)acrylate, pyrrolidinyl ethyl (meth)acrylate, and piperidinyl ethyl (meth)acrylate).

As the thermosetting (meth)acrylic resin, an acrylic resin having a number-average molecular weight of from 1,000 to 20,000 (preferably, from 1,500 to 15,000).

When the number-average molecular weight is in the above range, the smoothness and the mechanical properties of the coating film are easily enhanced.

The number-average molecular weight of the thermosetting (meth)acrylic resin is measured by gel permeation chromatography (GPC). The molecular weight measurement by GPC is performed by using the HLC-8120 GPC system manufactured by Tosoh Corporation as the measuring apparatus, TSKgel SuperHM-M columns (15 cm) manufactured by Tosoh Corporation, and the THF solvent. The weight-average molecular weight and the number-average molecular weight are calculated by using a molecular weight calibration curve created by monodisperse polystyrene standard samples from the measurement results.

Thermosetting Polyester Resin

The thermosetting polyester resin is, for example, a polycondensate made by polycondensation of at least a polybasic acid and a polyol. The introduction of a curing reactive group of the thermosetting polyester resin is achieved by adjusting the use amount of the polybasic acid and the polyol. Through this adjustment, a thermosetting polyester resin having at least one of a carboxyl group and a hydroxyl group as the curing reactive group is obtained.

Examples of the polybasic acid include: terephthalic acid, isophthalic acid, phthalic acid, methylterephthalic acid, trimellitic acid, pyromellitic acid, and anhydrides of these acids; succinic acid, adipic acid, azelaic acid, sebacic acid, and anhydrides of these acids; maleic acid, itaconic acid, and anhydrides of these acids; fumaric acid, tetrahydrophthalic acid, methyltetrahydrophthalic acid, hexahydrophthalic acid, methylhexahydrophthalic acid, and anhydrides of these acids; cyclohexanedicarboxylic acid, and 2,6-naphthalenedicarboxylic acid.

Examples of the polyol include ethylene glycol, diethylene glycol, propylene glycol, dipropylene glycol, 1,3-butanediol, 1,4-butanediol, 1,5-pentanediol, 1,6-hexanediol, neopentyl glycol, triethylene glycol, bis-hydroxyethyl terephthalate, cyclohexanedimethanol, octanediol, diethylpropanediol, butyl ethyl propanediol, 2-methyl-1,3-propanediol, 2,2,4-trimethylpentanediol, hydrogenated bisphenol-A, an ethylene oxide adduct of hydrogenated bisphenol-A, a propylene oxide adduct of hydrogenated bisphenol-A, trimethylolethane, trimethylol propane, glycerin, pentaerythritol, tris-hydroxyethyl isocyanurate, and hydroxypivalyl hydroxypivalate.

The thermosetting polyester resin may also be subjected to polycondensation with another monomer other than the polybasic acid and the polyol.

Examples of the other monomer include a compound containing a carboxyl group and a hydroxyl group in a molecule (for example, dimethanol propionic acid and hydroxypivalate), a monoepoxy compound (for example, a glycidyl ester of a branched aliphatic carboxylic acid such as "Cardura E10 (manufactured by Shell Chemicals)"), various types of monohydroxy alcohols (for example, methanol, propanol, butanol, and benzyl alcohol), various types of monobasic acids (for example, benzoic acid, and p-tert-butyl benzoic acid), and various types of fatty acids (for example, castor oil fatty acid, coconut oil fatty acid, and soybean oil fatty acid).

The structure of the thermosetting polyester resin may be a branched structure or a linear structure.

As the thermosetting polyester resin, a polyester resin in which the sum of the acid value and the hydroxyl value is from 10 mgKOH/g to 250 mgKOH/g and the number-average molecular weight is from 1,000 to 100,000 is preferable.

When the sum of the acid value and the hydroxyl value is in the above range, the smoothness and the mechanical properties of the coating film are easily enhanced. When the number-average molecular weight is in the above range, the smoothness and the mechanical properties of the coating film are enhanced, and the storage stability of the powder coating material is easily enhanced.

The measurement of the acid value and the hydroxyl value of the thermosetting polyester resin is based on JIS K 0070:1992. The measurement of the number-average molecular weight of the thermosetting polyester resin is performed in the same manner as the measurement of the number-average molecular weight of the thermosetting (meth)acrylic resin.

Thermosetting resins may be used singly or in a combination of two or more types thereof.

The content of the thermosetting resin is preferably from 20% by weight to 99% by weight with respect to the total of the powder particles and preferably from 30% by weight to 95% by weight.

In addition, when the thermosetting resin is applied as the resin of the resin coating portion, the content of the thermosetting resin means the total content of the thermosetting resins of the core and the resin coating portion.

Thermal Curing Agent

The thermal curing agent is selected according to the type of the curing reactive group of the thermosetting resin.

Specifically, in a case where the curing reactive group of the thermosetting resin is an epoxy group, examples of the thermal curing agent include: acids including succinic acid, glutaric acid, adipic acid, pimelic acid, suberic acid, azelaic acid, sebacic acid, dodecanedioic acid, eicosanedioic acid, maleic acid, citraconic acid, itaconic acid, glutaconic acid, phthalic acid, tetrahydrophthalic acid, hexahydrophthalic acid, cyclohexene-1,2-dicarboxylic acid, trimellitic acid, and pyromellitic acid; anhydrides of these acids; and urethane-modified products of these acids. Among these, as the thermal curing agent, an aliphatic dibasic acid is preferable in terms of the properties of the coating film and storage stability, and a dodecanedioic acid is particularly preferable in terms of the properties of the coating film.

In a case where the curing reactive group of the thermosetting resin is a carboxyl group, examples of the thermal curing agent include various types of epoxy resins (for example, polyglycidyl ether of bisphenol-A), epoxy group-containing acrylic resins (for example, glycidyl group-containing acrylic resin), various types of polyglycidyl ethers of polyols (for example, 1,6-hexanediol, trimethylolpropane, and trimethylolethane), various types of polyglycidyl esters of polycarboxylic acids (for example, phthalic acid, terephthalic acid, isophthalic acid, hexahydrophthalic acid, methylhexahydrophthalic acid, trimellitic acid, and pyromellitic acid), various types of alicyclic epoxy group-containing compounds (for example, bis(3,4-epoxycyclohexyl) methyl adipate), hydroxyamide (for example, triglycidyl isocyanurate, and β-hydroxyalkylamide).

In a case where the curing reactive group of the thermosetting resin is a hydroxyl group, examples of the thermal curing agent include polyblocked isocyanate and aminoplast. Examples of polyblocked polyisocyanate include: organic diisocyanates including various types of aliphatic diisocyanates (for example, hexamethylene diisocyanate, and trimethylhexamethylene diisocyanate), various types of alicyclic diisocyanates (for example, xylylene diisocyanate, and isophorone diisocyanate), various types of aromatic diisocyanates (for example, tolylene diisocyanate, and 4,4'-diphenylmethane diisocyanate); adducts of the organic diisocyanates and polyols, low-molecular-weight polyester resins (for example, polyester polyol), or water; polymers of organic diisocyanates (a polymer also including an isocyanurate-type polyisocyanate compound); various types of blocked polyisocyanate compounds such as an isocyanate biuret product, blocked by a well-known blocking agent; self-blocked polyisocyanate compound having an uretdione bond as a structure unit.

Thermal curing agents may be used singly or in a combination of two or more types thereof.

The content of the thermal curing agent is preferably from 1% by weight to 30% by weight with respect to the content of the thermosetting resin, and preferably from 3% by weight to 20% by weight.

In a case where the thermosetting resin is applied as the resin of the resin coating portion, the content of the thermal curing agent means the content thereof with respect to the total content of the thermosetting resins of the core and the resin coating portion.

Colorant

Examples of the colorant include a pigment. A dye may also be used together with the pigment as the colorant.

Examples of the pigment include: inorganic pigments including iron oxide (for example, red ocher), titanium oxide, titan yellow, zinc oxide, lead white, zinc sulfide, lithopone, antimony oxide, cobalt blue, and carbon black; and organic pigments including quinacridone red, phthalocyanine blue, phthalocyanine green, permanent red, Hansa yellow, indanthrene blue, brilliant fast scarlet, and benzimidazolone yellow.

In addition, as the pigment, a brilliant pigment may also be employed. Examples of the brilliant pigment include: metal powder including pearl pigment, aluminum powder, and stainless steel powder; metal flake; glass beads; glass flake; mica; and flaky iron oxide (MIO).

Colorants may be used singly or in a combination of two or more types thereof.

The content of the colorant is selected according to the type of the pigment, the color, brightness, and depth required of the coating film, and the like. For example, the content of the colorant is preferably from 1% by weight to 70% by weight with respect to the total content of the resins of the core and the resin coating portion, and preferably from 2% by weight to 60% by weight.

Other Additives

As the other additives, various types of additives used in the powder coating material may be employed. Specifically, examples of the other additives include surface adjusting agents (silicone oil, acrylic oligomers, and the like), foam inhibitors (for example, benzoin, and benzoin derivatives), curing accelerators (amine compounds, imidazole compounds, and cationic polymerization catalysts), plasticizers, charge-controlling agents, antioxidants, pigment dispersants, flame retardants, and fluidity imparting agents.

Resin Coating Portion

The resin coating portion contains a resin. The resin coating portion may be made of only a resin or may also contain other additives (the thermal curing agent described for the core, the other additives, and the like). However, in terms of a further reduction in the bleed of the powder particles, the resin coating portion may preferably be made of only a resin. Even in a case where the resin coating portion contains the other additives, the resin may preferably occupy 90% by weight or higher (preferably 95% by weight or higher) with respect to the total content of the resin coating portion.

The resin of the resin coating portion may be a non-curable resin or may also be a thermosetting resin. However, the resin of the resin coating portion may preferably be a thermosetting resin in terms of the enhancement of the curing density (crosslink density) of the coating film. In a case where the thermosetting resin is applied as the resin of the resin coating portion, as the thermosetting resin, the same resin as the thermosetting resin of the core may be employed. Particularly, even in the case where the thermosetting resin is applied as the resin of the resin coating portion, the thermosetting resin is preferably at least one type selected from the group consisting of a thermosetting (meth)acrylic resin and a thermosetting polyester resin. However, the thermosetting resin of the resin coating portion may be the same type of thermosetting resin of the core or may be a different resin.

In a case where the non-curable resin is applied as the resin of the resin coating portion, as the non-curable resin, at least one type selected from the group consisting of an acrylic resin and a polyester resin is appropriately employed.

The coverage of the resin coating portion is preferably from 30% to 100% in terms of bleed suppression, and more preferably from 50% to 100%.

The coverage of the resin coating portion is a value obtained by XPS (X-ray photoelectron spectroscopy) measurement of the coverage of the resin coating portion on the surface of the powder particles.

Specifically, XPS measurement is performed by using the JPS-9000MX spectrometer manufactured by JEOL Ltd. as the measuring apparatus, using an MgKα ray as the X-ray source, and setting an acceleration voltage to 10 kV and an emission current to 30 mA.

From the spectrum obtained under the above conditions, a separation of peaks of the components from the material of the core and the components from the material of the resin coating portion on the surface of the powder particle is performed, and the coverage of the resin coating portion of the surface of the powder particle is quantitated. During the peak separation, the measured spectrum is separated into respective components by using curve fitting according to the least square method.

As the component spectrum as the base of the separation, a spectrum obtained by separately measuring the thermosetting resin, the thermal curing agent, the pigment, the additives, and the coating resin used to prepare the powder particles is used. The coverage is obtained from the ratio of the spectrum intensity caused by the coating resin to the sum of the full spectrum intensities obtained from the powder particles.

The thickness of the resin coating portion is preferably from 0.2 μm to 4 μm in terms of bleed suppression, and more preferably from 0.3 μm to 3 μm.

The thickness of the resin coating portion is a value measured by the following method. A thin piece is prepared by embedding the powder particles in an epoxy resin or the like and cutting the resultant with a diamond knife or the like. The thin piece is observed by a transmission electron microscope (TEM) or the like, and the cross-sectional image of plural powder particles is photographed. From the cross-sectional image of the powder particles, the thickness of the resin coating portion is measured at 20 positions and the average value thereof is employed. In a case where it is difficult to observe the resin coating portion from the cross-sectional image in a clear powder coating material or the like, dyeing is performed for the observation to facilitate measurement.

Other Components of Powder Particles

The powder particles may preferably contain divalent or higher valent metal ions (hereinafter, also simply referred to as "metal ions"). The metal ions are components contained in any of the core and the resin coating portion of the powder particles. When the divalent or higher valent metal ions are contained in the powder particles, ionic cross-links are formed by the metal ions in the powder particles. For example, in a case where a polyester resin is used as the thermosetting resin of the core and the resin of the resin coating portion, the carboxyl group or the hydroxyl group of the polyester resin and the metal ions interact with each other and form ionic cross-links. Due to the ionic cross-links, the bleed of the powder particles is prevented and thus storage properties are easily enhanced. In addition, the bonds of the ionic cross-links break by heating the ionic cross-links during thermal curing after coating of the powder coating material. Therefore, the melt viscosity of the powder coating material is reduced, and thus a coating film having high smoothness is easily formed.

Examples of the metal ions include divalent to quadrivalent metal ions. Specifically, examples of the metal ions include at least one type of metal ions selected from the group consisting of aluminum ions, magnesium ions, iron ions, zinc ions, and calcium ions.

Examples of a supply source of the metal ions (a compound contained as the additive in the powder particles) include a metal salt, an inorganic metal salt polymer, and a metal complex. The metal salt and the inorganic metal salt polymer are added to the powder particles as an aggregating agent in a case of, for example, the powder particles are prepared by an aggregation and coalescence method.

Examples of the metal salt include aluminum sulfate, aluminum chloride, magnesium chloride, magnesium sulfate, iron dichloride, zinc chloride, calcium chloride, and calcium sulfate.

Examples of the inorganic metal salt polymer include polyaluminum chloride, polyaluminum hydroxide, polyferric sulfate, and calcium polysulfide.

Examples of the metal complex include a metal salt of aminocarboxylic acid. Specifically, examples of the metal complex include metal salts (for example, calcium salt, magnesium salt, iron salt, and aluminum salt) based on a well-known chelate such as ethylenediaminetetraacetic acid, propanediaminetetraacetic acid, nitrilotriacetic acid, triethylenetetraaminehexaacetic acid, and diethylenetriaminepentaacetic acid.

The supply source of the metal ions may also be simply added as an additive not for an aggregating agent.

As the valence of the metal ions increases, mesh-like ionic cross-links are more likely to be formed, which is preferable in terms of the smoothness of the coating film and the storage properties of the powder coating material. Therefore, as the metal ions, Al ions are preferable. That is, as the supply source of the metal ions, aluminum salts (for example, aluminum sulfate and aluminum chloride), and a polymer of an aluminum salt (for example, polyaluminum chloride and polyaluminum hydroxide) are preferable. Furthermore, in terms of the smoothness of the coating film and the storage properties of the powder coating material, among the supply sources of the metal ions, an inorganic metal salt polymer is more preferable than metal salts even when the valence of the metal ions is the same. Therefore, as the supply source of the metal ions, the polymer of an aluminum salt (for example, polyaluminum chloride and polyaluminum hydroxide) is preferable.

The content of the metal ions is preferably from 0.002% by weight to 0.2% by weight with respect to the entirety of the powder particles and more preferably from 0.005% by weight to 0.15% by weight in terms of the smoothness of the coating film and the storage properties of the powder coating material.

When the content of the metal ions is equal to or higher than 0.002% by weight, appropriate ionic cross-links are formed by the metal ions and thus the bleed of the powder particles is prevented. Therefore, the storage properties of the coating material are easily enhanced. On the other hand, when the content of the metal ions is equal to or less than 0.2% by weight, an excessive formation of ionic cross-links due to the metal ions is prevented, and thus the smoothness of the coating film is easily enhanced.

Here, in a case where the powder particles are prepared by the aggregation and coalescence method, the supply source of the metal ions (metal salts, and a metal salt polymer) added as the aggregating agent contributes to the control of the particle size distribution and shapes of the powder particles.

Specifically, a higher valence of the metal ions is more appropriate to obtain a narrow particle size distribution. In addition, in order to obtain a narrow particle size distribution, a metal salt polymer is more appropriate than metal salts even when the valence of the metal ions is the same.

Therefore, for the above reasons, as the supply source of the metal ions, aluminum salts (for example, aluminum sulfate and aluminum chloride), and a polymer of an aluminum salt (for example, polyaluminum chloride and polyaluminum hydroxide) are preferable, and a polymer of an aluminum salt (for example, polyaluminum chloride and polyaluminum hydroxide) are particularly preferable.

When the aggregating agent is added so that the content of the metal ions is equal to or higher than 0.002% by weight, the aggregation of resin particles in an aqueous medium proceeds, which contributes to the realization of a narrow particle size distribution. In addition, the aggregation of resin particles which form the resin coating portion proceeds for the aggregated particles which form the core, which contributes to the realization of the formation of the resin coating portion for the entire surface of the core. On the other hand, when the aggregating agent is added so that the content of the metal ions is equal to or less than 0.2% by weight, an excessive generation of the ionic cross-links in the aggregated particles is prevented. Therefore, when the particles are coalesced, the shapes of the formed powder particles are likely to become spherical shapes. Therefore, for the above reasons, the content of the metal ions is preferably from 0.002% by weight to 0.2% by weight and more preferably from 0.005% by weight to 0.15% by weight.

The content of the metal ions is measured by quantitatively analyzing the intensity of fluorescent X-rays of the powder particles. Specifically, for example, first, a resin mixture in which the metal ions have a known concentration is obtained by mixing a resin and the supply source of the metal ions. 200 mg of the resin mixture is pelletized by a pelletizing machine having a diameter of 13 mm, thereby obtaining a pellet sample. The weight of the pellet sample is precisely weighed, and fluorescent X-ray intensity measurement of the pellet sample is performed, thereby obtaining peak intensities. Similarly, the measurement is also performed on pellet samples in which the amount of the supply source of the metal ions being added is changed, and a calibration curve is created from the measurement results. By using the calibration curve, the content of the metal ions in the powder particles as the measuring object is quantitatively analyzed.

Examples of the method of adjusting the content of the metal ions include 1) a method of adjusting the amount of the supply source of the metal ions being added, and 2) in a case where the powder particles are prepared by the aggregation and coalescence method, a method of adjusting the content of the metal ions by adding an aggregating agent (for example, metal salts or a metal salt polymer) as the supply source of the metal salts in an aggregation process, thereafter adding a chelating agent (for example, EDTA (ethylenediaminetetraacetic acid), DTPA (diethylenetriaminepentaacetic acid), and NTA (nitrilotriacetic acid)) thereto at the end of the aggregation process, forming a complex with the metal ions by the chelating agent, and removing the formed complex salts in a subsequent washing process or the like.

External Additives

The external additives prevent the generation of aggregates of the powder particles to form a coating film having high smoothness with a small amount of material. Specific examples of the external additives include inorganic particles. Examples of the inorganic particles include particles such as $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles as the external additives may be subjected to a hydrophobizing treatment with a hydrophobizing agent. The hydrophobizing treatment is performed by, for example, immersing the inorganic particles in a hydrophobizing agent or the like. The hydrophobizing agent is not particularly limited, and examples thereof include a silane-based coupling agent, silicone oil, a titanate-based coupling agent, and an aluminum-based coupling agent. The agents may be used singly or in a combination of two or more types thereof.

Typically, the amount of the hydrophobizing agent is, for example, from 1 part by weight to 10 parts by weight with respect to 100 parts by weight of the inorganic particles.

The amount of the external additives being externally added is, for example, preferably from 0.01% by weight to 5% by weight with respect to the amount of the powder particles and more preferably from 0.01% by weight to 2.0% by weight.

Method of Preparing Powder Coating Material

Next, a method of preparing the powder coating material according to this exemplary embodiment will be described.

The powder coating material according to this exemplary embodiment is obtained by preparing the powder particles and thereafter externally adding the external additives to the powder particles as necessary.

The powder particles may be prepared by any of a dry preparation method (for example, a kneading and pulverizing method) and a wet preparation method (for example, an aggregation and coalescence method, a suspension polymerization method, and a dissolution suspension method). The method of preparing the powder particles is not particularly limited to the above preparation methods, and a well-known preparation method may also be employed.

Among these, in order to easily control the volume-based particle size distribution index GSDv and the average circularity to be in the above ranges, the powder particles may be obtained by the aggregation and coalescence method.

Specifically, the powder particles may preferably be prepared through processes of:

forming first aggregated particles by allowing, in a dispersion in which first resin particles containing a thermosetting resin, and a thermal curing agent are dispersed, the first resin particles and the thermal curing agent to aggregate, or by allowing, in a dispersion in which composite particles containing a thermosetting resin and a thermal curing agent are dispersed, the composite particles to aggregate;

mixing a first aggregated particle dispersion in which the first aggregated particles are dispersed with a second resin particle dispersion in which second resin particles containing a resin are dispersed, allowing aggregation such that the second resin particles stick to the surfaces of the first aggregated particles, and thereby forming second aggregated particles in which the second resin particles stick to the surfaces of the first aggregated particles; and heating a second aggregated particle dispersion in which the second aggregated particles are dispersed to allow the second aggregated particles to coalesce to each other.

In addition, in the powder particles prepared by the aggregation and coalescence method, a part in which the first aggregated particles coalesce becomes the core, and a part in which the second resin particles sticking to the surfaces of the first aggregated particles coalesce becomes the resin coating portion.

Hereinafter, details of each process will be described.

In the following description, a method of preparing the powder particles containing a colorant is described. However, the colorant is contained as necessary.

Process of Preparing Each Dispersion

First, each of the dispersions used in the aggregation and coalescence method is used. Specifically, a first resin particle dispersion in which the first resin particles containing the thermosetting resin of the core are dispersed, a thermal curing agent dispersion in which the thermal curing agent is dispersed, a colorant dispersion in which the colorant is dispersed, and the second resin particle dispersion in which the second resin particles containing the resin of the resin coating portion are dispersed are prepared.

In addition, instead of the first resin particle dispersion and the thermal curing agent dispersion in which the thermal curing agent is dispersed, a composite particle dispersion in which the composite particles containing the thermosetting resin of the core and the thermal curing agent are dispersed is prepared.

In addition, in the process of preparing each dispersion, the first resin particles, the second resin particles, and the composite particles are collectively called "resin particles" in the description.

Here, the resin particle dispersion is prepared by, for example, dispersing the resin particles in a dispersion medium using a surfactant.

Examples of the dispersion medium used in the resin particle dispersion include an aqueous medium.

Examples of the aqueous medium include: water such as distilled water or ion-exchange water; and alcohols. These may be used singly or in a combination of two or more types thereof.

Examples of the surfactant include: anionic surfactants based on sulfate esters, sulfonates, phosphate esters, soaps, and the like; cationic surfactants based on amine salts, quaternary ammonium salts, and the like; and nonionic surfactants based on polyethylene glycol, alkyl phenol ethylene oxide adducts, polyols, and the like. Among these, the anionic surfactants and the cationic surfactants are particularly employed. The nonionic surfactants may be used together with the anionic surfactants or the cationic surfactants.

The surfactants may be used singly or in a combination of two or more types thereof.

Regarding the resin particle dispersion, examples of the method of dispersing the resin particles in the dispersion medium include general dispersing methods such as methods using a rotary shear homogenizer, and a ball mill, a sand mill and a dyno mill having a medium. Depending on the type of the resin particles, for example, the resin particles may be dispersed in the resin particle dispersion using a phase inversion emulsification method.

The phase inversion emulsification method is a method of dissolving a resin to be dispersed in a hydrophobic organic solvent in which the resin is soluble, adding a base to an organic continuous phase (O phase) for neutralization, and an aqueous medium (W phase) is injected thereto for resin conversion (so-called phase inversion) from W/O to O/W to form discontinuous phases such that the resin is dispersed in the aqueous medium in a particle form.

As the method of preparing the resin particle dispersion, specifically, for example, in a case of an acrylic resin particle dispersion, a raw material monomer is emulsified in water of an aqueous medium, and a water-soluble initiator, and as necessary, a chain transfer agent for controlling a molecular weight are added thereto, and the resultant is heated and is subjected to emulsion polymerization, thereby obtaining a resin particle dispersion in which the acrylic resin particles are dispersed.

In a case of a polyester resin particle dispersion, a raw material monomer is heated, melted, and subjected to polycondensation under reduced pressure, and the obtained polycondensate is added to a solvent (for example, ethyl acetate) and is dissolved, and the obtained dissolved material is stirred while an alkalescent aqueous solution is added thereto and subjected to phase inversion emulsification, thereby obtaining a resin particle dispersion in which the polyester resin particles are dispersed.

In a case of obtaining a composite particle dispersion, the resin and the thermal curing agent are mixed and dispersed in a dispersion medium (for example, emulsified through phase inversion emulsification or the like), thereby obtaining the composite particle dispersion.

The volume-average particle size of the resin particles dispersed in the resin particle dispersion may be, for example, equal to or less than 1 μm, and is preferably from 0.01 μm to 1 μm, more preferably from 0.08 μm to 0.8 μm, and even more preferably from 0.1 μm to 0.6 μm.

Regarding the volume-average particle size of the resin particles, a cumulative distribution of volumes is drawn from a small diameter side with respect to divided particle size ranges (channels) based on the particle size distribution obtained through measurement using a laser diffraction particle size distribution measuring apparatus (for example, LA-700 manufactured by HORIBA, Ltd.). A particle size corresponding to cumulative 50% with respect to the total particles is measured as a volume-average particle size D50v. The volume-average particle size of particles in the other dispersions is measured in the same manner.

The content of the resin particles contained in the resin particle dispersion is, for example, preferably from 5% by weight to 50% by weight, and more preferably from 10% by weight to 40% by weight.

In the same manner as the resin particle dispersion, for example, the thermal curing agent dispersion, the colorant dispersion, and the composite particle dispersion are also prepared. That is, in the same manner as for the resin particles in the resin particle dispersion, the volume-average particle size, the dispersion medium, the dispersing method, and the content of the particles are obtained for the particles of the colorant dispersed in the colorant dispersion, the particles of the thermal curing agent dispersed in the thermal curing agent dispersion, and the composite particles dispersed in the composite particle dispersion.

Process of Forming First Aggregated Particles

Next, the first resin particle dispersion, the thermal curing agent dispersion, and the colorant dispersion are mixed with each other.

In the mixed dispersion, the first aggregated particles are formed which contain the first resin particles, the thermal curing agent, and the colorant and have a diameter close to the diameter of target powder particles by allowing the first resin particles, the thermal curing agent, and the colorant to undergo heteroaggregation.

Specifically, for example, the aggregating agent is added to the mixed dispersion, the pH of the mixed dispersion is adjusted to be acidic (for example, a pH of from 2 to 5), a dispersion stabilizer is added as necessary, and the resultant is then heated to a temperature of the glass-transition temperature of the first resin particles (specifically, for example, a temperature lower than the glass-transition temperature of the first resin particles by 30° C. to 10° C.) to allow the particles dispersed in the mixed dispersion to aggregate, thereby forming the first aggregated particles.

Alternatively, in the process of forming the first aggregated particles, the composite particle dispersion containing the thermosetting resin and the thermal curing agent and the colorant dispersion may be mixed with each other to allow the composite particles and the colorant in the mixed dispersion to undergo heteroaggregation, thereby forming the first aggregated particles.

In the process of forming the first aggregated particles, for example, the heating may be performed after adding the aggregating agent at room temperature (for example, 25° C.) while stirring the mixed dispersion by a rotary shear homogenizer, adjusting the pH of the mixed dispersion to be acidic (for example, a pH of from 2 to 5), and adding the dispersion stabilizer as necessary.

Examples of the aggregating agent include a surfactant having the opposite polarity to that of the surfactant used as the dispersant added to the mixed dispersion, metal salts, a metal salt polymer, and a metal complex. In a case where the metal complex is used as the aggregating agent, the amount of the surfactant being used is reduced and thus charging properties are enhanced.

After the aggregation ends, an additive which forms a complex or similar bonds with metal ions of the aggregating agent may be used as necessary. As the additive, a chelating agent is appropriately used. In a case where the aggregating agent is excessively added, the adjustment of the content of the metal ions of the powder particles is obtained by the addition of the chelating agent.

Here, metal salts, a metal salt polymer, and a metal complex as the aggregating agent are used as the supply source of the metal ions. Exemplification thereof is described above.

As the chelating agent, a water-soluble chelating agent may be employed. Specifically, examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent being added may be, for example, from 0.01 parts by weight to 5.0 parts by weight with respect to 100 parts by weight of the resin particles, and is preferably equal to or higher than 0.1 parts by weight and less than 3.0 parts by weight.

Process of Forming Second Aggregated Particles

Next, the obtained first aggregated particle dispersion in which the obtained first aggregated particles are dispersed and the second resin particle dispersion are mixed with each other.

The second resin particles may be the same type as the first resin particles or may be a different type.

In addition, the second aggregated particles in which the second resin particles stick to the surfaces of the first aggregated particles are formed by allowing aggregation such as, in the mixed dispersion in which the first aggregated particles and the second resin particles are dispersed, the second resin particles stick to the surfaces of the first aggregated particles.

Specifically, for example, when the first aggregated particles reach a desired particle size in the process of forming the first aggregated particles, the second resin particle dispersion is mixed with the first aggregated particle dispersion, and heating is performed on the mixed dispersion at a temperature of equal to or less than the glass-transition temperature of the second resin particles.

In addition, by adjusting the pH of the mixed dispersion to be in a range of, for example, from 6.5 to 8.5, approximately, the progress of the aggregation is stopped.

Accordingly, the second aggregated particles aggregated in such a way that the second resin particles stick to the surfaces of the first aggregated particles are obtained.

Coalescing Process

Next, the second aggregated particle dispersion in which the second aggregated particles are dispersed is heated at a temperature equal to or higher than the glass-transition temperature of the first and second resin particles (for example, equal to or higher than a temperature higher than the glass-transition temperature of the first and second resin particles by 10 to 30° C.) to coalesce the second aggregated particles, thereby forming the powder particles.

The powder particles are obtained through the above processes.

Here, after the coalescing process ends, the powder particles formed in the dispersion are subjected to a well-known washing process, a solid-liquid separation process, and a drying process to obtain powder particles in a dried state.

As the washing process, in terms of charging properties, it is preferable that displacement washing by ion-exchange water may be sufficiently performed. In addition, although the solid-liquid separation process is not particularly limited, in terms of productivity, it is preferable that suction filtration, pressure filtration, or the like may be performed. In addition, although the drying process is not particularly limited as to the methods thereof, in terms of productivity, it is preferable that freeze-drying, flash drying, fluidized drying, vibratory fluidized drying, or the like may be performed.

The powder coating material according to this exemplary embodiment is prepared by, for example, adding and mixing the external additives as necessary with the obtained powder particles in a dried state. The mixing may be performed preferably by, for example, a V blender, a Henschel mixer, and a Lödige mixer. Furthermore, as necessary, toner coarse particles may be removed by using a vibratory sieving machine, a wind classifier, or the like.

Hereinafter, test examples which prove the effects of the powder coating material according to this exemplary embodiment are described. The powder coating material according to this exemplary embodiment is not limited to the test examples. In the following description, unless otherwise noted, both of "parts" and "%" are based on weight.

Preparation of Colorant Dispersion

Preparation of Colorant Dispersion (C1)

Cyan pigment (C. I. Pigment Blue 15:3 manufactured by Dainichiseika Color & Chemicals Mfg. Co., Ltd., (copper phthalocyanine)): 100 parts by weight Anionic surfactant (manufactured by Dai-ichi Kogyo Seiyaku Co., Ltd.: Neogen RK): 15 parts by weight Ion-exchange water: 450 parts by weight The above components are mixed, dissolved, and dispersed by using the high pressure impact type dispersing machine ULTIMIZER (HJP30006 manufactured by Sugino Machine Limited) for one hour, and thus a colorant dispersion in which the cyan pigment is dispersed is prepared. The volume-average particle size of the cyan pigment in the colorant dispersion is 0.13 m, and the solid content ratio of the colorant dispersion is 25%.

Preparation of Colorant Dispersion (M1)

A colorant dispersion (M1) is prepared by the same method as that of the colorant dispersion (C1) except that the cyan pigment is changed to a magenta pigment (quinacridon-based pigment: Chromofine Magenta 6887 manufactured by Dainichiseika Color & Chemicals Mfg. Co., Ltd.). The volume-average particle size of the magenta pigment in the colorant dispersion is 0.14 μm, and the solid content ratio of the colorant dispersion is 25%.

Preparation of Colorant Dispersion (M2)

A colorant dispersion (M2) is prepared by the same method as that of the colorant dispersion (C1) except that the cyan pigment is changed to a magenta pigment (Fastogen Super Red 7100Y-E manufactured by DIC Corporation). The volume-average particle size of the magenta pigment in the colorant dispersion is 0.14 μm, and the solid content ratio of the colorant dispersion is 25%.

Preparation of Colorant Dispersion (Y1)

A colorant dispersion (Y1) is prepared by the same method as that of the colorant dispersion (C1) except that the cyan pigment is changed to a yellow pigment (Paliotol Yellow D 1155 manufactured by BASF Company Ltd.). The volume-average particle size of the yellow pigment in the colorant dispersion is 0.13 μm, and the solid content ratio of the colorant dispersion is 25%.

Preparation of Colorant Dispersion (K1)

A colorant dispersion (K1) is prepared by the same method as that of the colorant dispersion (C1) except that the cyan pigment is changed to a black pigment (Reagal 330 manufactured by Cabot Corporation). The volume-average particle size of the black pigment in the colorant dispersion is 0.11 μm, and the solid content ratio of the colorant dispersion is 25%.

Preparation of Colorant Dispersion (W1)

Titanium oxide (A-220 manufactured by Ishihara Sangyo Kaisha, Ltd.): 100 parts by weight Anionic surfactant (manufactured by Dai-ichi Kogyo Seiyaku Co., Ltd.: Neogen RK): 15 parts by weight Ion-exchange water: 400 parts by weight The above components are mixed, dissolved, and dispersed by using the high pressure impact type dispersing machine ULTIMIZER (HJP30006 manufactured by Sugino Machine Limited) for three hours, and thus a colorant dispersion in which the titanium oxide is dispersed is prepared. When measurement is performed by using a laser diffraction particle size measuring machine, the volume-average particle size of the titanium oxide in the colorant dispersion is 0.25 μm, and the solid content ratio of the colorant dispersion is 25%.

Test Example 1: Clear Powder Coating Material Made of Acrylic Resin (PCA1)

Preparation of Thermosetting Acrylic Resin Particle Dispersion (A1)

Styrene: 160 parts by weight

Methyl methacrylate: 200 parts by weight n-butyl acrylate: 140 parts by weight

Acrylic acid: 12 parts by weight

Glycidyl methacrylate: 100 parts by weight

Dodecanethiol: 12 parts by weight

The above components are mixed and dissolved to prepare a monomer solution A.

On the other hand, 12 parts by weight of the anionic surfactant (DOWFAX manufactured by The Dow Chemical Company) are dissolved in 280 parts by weight of the ion-exchange water, the monomer solution A is added thereto, and the resultant is dispersed and emulsified in a flask, and thus a solution (monomer emulsified liquid A) is obtained.

Next, 1 part by weight of the anionic surfactant (DOWFAX manufactured by The Dow Chemical Company) is dissolved in 555 parts by weight of the ion-exchange water, and the resultant is put into a flask for polymerization. Thereafter, the flask for polymerization is airtightly sealed, a reflux pipe is provided, and while nitrogen is injected thereto and the resultant is slowly stirred, the flask for polymerization is heated by a water bath to 75° C. and is held.

In this state, a solution obtained by dissolving 9 parts by weight of ammonium persulfate in 43 parts by weight of the ion-exchange water is dropped for 20 minutes via a metering pump, and the monomer emulsified liquid A is further dropped for 200 minutes via a metering pump. After ending the dropping, the flask for polymerization is held at 75° C. for 3 hours while the resultant is continuously slowly stirred, and the polymerization is ended, and thus an anionic thermosetting acrylic resin particle dispersion (A1) having a solid content of 42% is obtained.

The volume-average particle size of the thermosetting acrylic resin particles contained in the anionic thermosetting acrylic resin particle dispersion (A1) is 220 nm, the glass-transition temperature thereof is 55° C., and the weight-average molecular weight thereof is 24,000.

Preparation of Thermal curing agent Dispersion (D1)

Dodecanedioic acid: 50 parts by weight

Benzoin: 1 part by weight

Acrylic oligomer (Acronal 4F, BASF Company Ltd.): 1 part by weight

Anionic surfactant (DOWFAX manufactured by The Dow Chemical Company): 5 parts by weight Ion-exchange water: 200 parts by weight The above components are heated in a pressure container at 140° C. and are dispersed by using a homogenizer (ULTRA-TURRAX T50 manufactured by IKA Corporation), and the resultant is then subjected to a dispersion treatment by the Manton-Gaulin high pressure homogenizer (Manton-Gaulin Manufacturing Co., Inc.), and thus a thermal curing agent dispersion (D1) (a thermal curing agent concentration of 23%) in which the thermal curing agent having an average particle size of 0.24 μm and the other additives are dispersed is prepared.

Preparation of Clear Powder Coating Material (PCA1)

Aggregation Process

Thermosetting acrylic resin particle dispersion (A1): 200 parts by weight (the resin content is 84 parts by weight)

Thermal curing agent dispersion (D1): 91 parts by weight (the thermal curing agent content is 21 parts by weight)

10% polyaluminum chloride: 1 part by weight

The above components are sufficiently mixed and dispersed by the homogenizer (ULTRA-TURRAX T50 manufactured by IKA Corporation) in a stainless steel round flask, are heated to 48° C. while stirring the flask in a heating oil bath, and are held at 48° C. for 60 minutes. Thereafter, 68 parts by weight (the resin content is 28.56 parts by weight) of the thermosetting acrylic resin particle dispersion (A1) are added, and the resultant is slowly stirred.

Coalescing Process

Thereafter, the pH of the solution in the flask is adjusted to 5.0 using 0.5 mol/liter of a sodium hydroxide aqueous solution, and the obtained solution is then heated to 95° C. while being continuously stirred. After the heating of the solution in the flask to 85° C. is ended, this state is maintained for 4 hours. The pH of the solution when the temperature is maintained at 85° C. is about 4.0.

Filtration, Washing, and Drying Process

After the reaction ends, the solution in the flask is cooled and filtered, and thus a solid content is obtained. Next, the solid content is sufficiently washed by ion-exchange water and is then subjected to solid-liquid separation through Nutsche suction filtration, and thus a solid content is obtained again.

Next, the solid content is re-dispersed in 3 liters of ion-exchange water at 40° C. and is stirred and washed at 300 rpm for 15 minutes. The washing operation is repeated 5 times, and the solid content obtained by the solid-liquid separation through the Nutsche suction filtration is subjected to vacuum drying for 12 hours. Thereafter, 0.5 parts by weight of hydrophobic silica particles (a primary particle size of 16 nm) are added to 100 parts by weight of the solid content as the external additive, and thus the clear powder coating material (PCA1) made of an acrylic resin is obtained.

The volume-average particle size D50v of the powder particles of the clear powder coating material is 5.9 μm, the volume-average particle size distribution index GSDv is 1.20, and the average circularity is 0.99.

The clear powder coating material (the powder particles thereof) is embedded in an epoxy resin, and the resultant is cut and the cross-sectional image of the particles is observed by a transmission electron microscope. It is confirmed that the surface of the powder particle is coated with the resin coating portion.

In addition, the content of aluminum ions in the powder particles of the clear powder coating material is 0.08% by weight.

Test Example 2: Colored Powder Coating Material (PCE1) Made of Polyester Resin

Preparation of Thermosetting Polyester Resin (PES1)

A raw material having the following composition is put into a reaction container provided with a stirrer, a thermometer, a nitrogen gas inlet port, and a rectifier, and is subjected to a polycondensation reaction by increasing the temperature of the raw material to 240° C. while stirring the raw material under a nitrogen atmosphere.

Terephthalic acid: 742 parts by weight (100 mol %)
Neopentyl glycol: 312 parts by weight (62 mol %)
Ethylene glycol: 59.4 parts by weight (20 mol %)
Glycerin: 90 parts by weight (18 mol %)
Di-n-butyltin oxide: 0.5 parts by weight In regard to the obtained thermosetting polyester resin, the glass-transition temperature is 55° C., the acid value (Av) is 8 mg KOH/g, the hydroxyl value (OHv) is 70 mg KOH/g, the weight-average molecular weight is 26,000, and the number-average molecular weight is 8,000.

Preparation of Composite Particle Dispersion (E1)

While a jacketed 3-liter reaction vessel (BJ-30N manufactured by Tokyo Rikakikai Co., LTD.) provided with a condenser, a thermometer, a water-dropping device, and an anchor blade is maintained at 40° C. in a water-circulating thermostatic bath, a mixed solvent of 180 parts by weight of ethyl acetate and 80 parts by weight of isopropyl alcohol is injected into the reaction vessel, and the following composition is injected into the resultant.

Thermosetting polyester resin (PES1): 240 parts by weight
Blocked isocyanate thermal curing agent VESTAGON B 1530 (manufactured by Evonik Japan Co., Ltd.): 60 parts by weight
Benzoin: 3 parts by weight
Acrylic oligomer (Acronal 4F, BASF Company Ltd.): 3 parts by weight After the injection, the resultant is stirred at 150 rpm using a three-one motor to be dissolved, and thus an oil phase is obtained. In the oil phase being stirred, 1 part by weight of a 10% by weight ammonia aqueous solution and 47 parts by weight of a 5% by weight sodium hydroxide aqueous solution are dropped for 5 minutes and are mixed for 10 minutes. Thereafter, 900 parts by weight of ion-exchange water are dropped at a speed of 5 parts by weight per minute for phase inversion, and thus an emulsified liquid is obtained.

800 parts by weight of the obtained emulsified liquid and 700 parts by weight of the ion-exchange water are input into a 2-liter eggplant flask, and the resultant is set in an evaporator (manufactured by Tokyo Rikakikai Co., LTD.) provided with a vacuum control unit via trap balls. While rotating the eggplant flask, the resultant is heated by a hot water bath at 60° C. and is decompressed to 7 kPa while being careful of bumping, and thus a solvent is removed therefrom. At the time when the amount of the solvent being collected becomes 1,100 parts by weight, the pressure is returned to the normal pressure, and the eggplant flask is water-cooled, and thus a dispersion is obtained. There is no solvent odor in the obtained dispersion. The volume-average particle size of the composite particles containing the thermosetting polyester resin and the thermal curing agent in the dispersion is 150 nm.

Thereafter, 2% by weight of an anionic surfactant (DOWFAX 2A1 manufactured by The Dow Chemical Company, the amount of effective components is 45% by weight) is added and mixed as an effective component with respect to the resin component in the dispersion, and the concentration of the solid content thereof is adjusted to 20% by weight by adding ion-exchange water. This is used as a composite particle dispersion (E1) containing the polyester resin and the thermal curing agent.

Preparation of Thermosetting Polyester Resin Particle Dispersion (E2)

A thermosetting polyester resin particle dispersion (E2) is obtained under the same conditions as those for preparing the composite particle dispersion (E1) except that 300 parts by weight of the thermosetting polyester resin (PES1) is used and the blocked isocyanate thermal curing agent, the benzoin, and the acrylic oligomer are not added.

Preparation of Colored Powder Coating Material (PCE1)

Aggregation Process

Composite particle dispersion (E1): 325 parts by weight (the solid content is 65 parts by weight)
Colorant dispersion (C1): 3 parts by weight (the solid content is 0.75 parts by weight)
Colorant dispersion (W1): 150 parts by weight (the solid content is 37.5 parts by weight)

The above components are sufficiently mixed and dispersed by the homogenizer (ULTRA-TURRAX T50 manufactured by IKA Corporation) in a stainless steel round flask. Next, the pH of the resultant is adjusted to 2.5 by using a 1.0% nitric acid aqueous solution. 0.50 parts by weight of a 10% polyaluminum chloride aqueous solution are added thereto, and the dispersing operation is continuously performed by the ULTRA-TURRAX.

A stirrer and a heating mantle are installed, and while appropriately adjusting the rotation frequency of the stirrer so as to sufficiently stir the slurry, the temperature thereof is increased to 50° C. After holding the resultant for 15 minutes at 50° C., 100 parts by weight of the thermosetting polyester resin dispersion (E2) are slowly injected when the volume-average particle size of the resultant becomes 5.5 μm.

Coalescing Process

After the injection, the resultant is held for 30 minutes, and the pH thereof is adjusted to 6.0 by using a 5% sodium hydroxide aqueous solution. Thereafter, the temperature thereof is increased to 85° C. and is held for 2 hours. Substantially spheroidized particles are observed by an optical microscope.

Filtration, Washing, and Drying Process

After the reaction ends, the solution in the flask is cooled and filtered, and thus a solid content is obtained. Next, the solid content is sufficiently washed by ion-exchange water and is then subjected to solid-liquid separation through Nutsche suction filtration, and thus a solid content is obtained again.

Next, the solid content is re-dispersed in 3 liters of ion-exchange water at 40° C. and is stirred and washed at 300 rpm for 15 minutes. The washing operation is repeated 5 times, and the solid content obtained by the solid-liquid separation through the Nutsche suction filtration is subjected to vacuum drying for 12 hours. Thereafter, 0.5 parts by weight of hydrophobic silica particles (a primary particle size of 16 nm) are added to 100 parts by weight of the solid content as the external additive, and thus the colored powder coating material (PCE1) made of a polyester resin is obtained.

The volume-average particle size D50v of the powder particles of the colored powder coating material is 6.5 μm, the volume-average particle size distribution index GSDv is 1.24, and the average circularity is 0.98.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the colored powder coating material (the powder particles thereof) is 0.1% by weight.

Test Example 3: Colored Powder Coating Material (PCE2) Made of Polyester

A colored powder coating material (PCE2) made of a polyester resin is obtained under the same conditions as those in Test Example 2 except that, after injecting 100 parts by weight of the thermosetting polyester resin particle dispersion (E2), 40 parts by weight of a 10% NTA (nitrilotriacetic acid) metal salt aqueous solution (CHELEST 70 manufactured by Chelest Co., Ltd.) are added, and the pH thereof is then adjusted to 6.0 by using a 5% sodium hydroxide aqueous solution.

The volume-average particle size D50v of the powder particles of the colored powder coating material is 6.8 μm, the volume-average particle size distribution index GSDv is 1.22, and the average circularity is 0.99.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

The content of aluminum ions in the colored powder coating material (the powder particles thereof) is 0.005% by weight.

Test Example 4: Clear Powder Coating Material (PCA2) Made of Acrylic Resin

A clear powder coating material (PCA2) made of an acrylic resin is obtained under the same conditions as those in Test Example 1 except that 1 part by weight of the 10% polyaluminum chloride is changed to 4 parts by weight of 5% magnesium chloride in the aggregation process.

The volume-average particle size D50v of the powder particles of the clear powder coating material is 7.0 μm, the volume-average particle size distribution index GSDv is 1.35, and the average circularity is 0.97.

The clear powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

The content of magnesium ions in the clear powder coating material (the powder particles thereof) is 0.17% by weight.

Test Example 5: Colored Powder Coating Material (PCA3) Made of Acrylic Resin

Preparation of Thermosetting Acrylic Resin Particle Dispersion (A2)

Styrene: 60 parts by weight
Methyl methacrylate: 240 parts by weight
Hydroxyethyl methacrylate: 50 parts by weight
Carboxyethyl acrylate: 18 parts by weight
Glycidyl methacrylate: 260 parts by weight
Dodecanethiol: 8 parts by weight The above components are mixed and dissolved, and thus a monomer solution A is prepared.

On the other hand, 12 parts by weight of the anionic surfactant (DOWFAX manufactured by The Dow Chemical Company) are dissolved in 280 parts by weight of the ion-exchange water, the monomer solution A is added thereto, and the resultant is dispersed and emulsified in a flask, and thus a solution (monomer emulsified liquid A) is obtained.

Next, 1 part by weight of the anionic surfactant (DOWFAX manufactured by The Dow Chemical Company) is dissolved in 555 parts by weight of the ion-exchange water, and the resultant is put into a flask for polymerization. Thereafter, the flask for polymerization is airtightly sealed, a reflux pipe is provided, and while nitrogen is injected thereto and the resultant is slowly stirred, the flask for polymerization is heated by a water bath to 75° C. and is held.

In this state, a solution obtained by dissolving 9 parts by weight of ammonium persulfate in 43 parts by weight of the ion-exchange water is dropped for 20 minutes via a metering pump, and the monomer emulsified liquid A is further dropped for 200 minutes via a metering pump. After ending the dropping, the flask for polymerization is held at 75° C. for 3 hours while the resultant is continuously slowly stirred, and the polymerization is ended, and thus an anionic thermosetting acrylic resin particle dispersion (A2) having a solid content of 42% is obtained.

In regard to the thermosetting acrylic resin particles contained in the anionic thermosetting acrylic resin particle dispersion (A2), the volume-average particle size of is 200 nm, the glass-transition temperature is 65° C., and the weight-average molecular weight is 31,000.

Preparation of Colored Powder Coating Material (PCA3)

Aggregation Process

Thermosetting acrylic resin particle dispersion (A2): 155 parts by weight (the solid content is 65 parts by weight)
Colorant dispersion (C1): 3 parts by weight (the solid content is 0.75 parts by weight)

Colorant dispersion (W1): 150 parts by weight (the solid content is 37.5 parts by weight)

The above components are sufficiently mixed and dispersed by the homogenizer (ULTRA-TURRAX T50 manufactured by IKA Corporation) in a stainless steel round flask. Next, the pH of the resultant is adjusted to 2.5 by using a 1.0% nitric acid aqueous solution. 0.70 parts by weight of a 10% polyaluminum chloride aqueous solution are added thereto, and the dispersing operation is continuously performed by the ULTRA-TURRAX.

A stirrer and a heating mantle are installed, and while appropriately adjusting the rotation frequency of the stirrer so as to sufficiently stir the slurry, the temperature thereof is increased to 60° C. After holding the resultant for 15 minutes at 60° C., 100 parts by weight of the thermosetting acrylic resin dispersion (A2) are slowly injected when the volume-average particle size of the resultant becomes 9.5 μm.

Coalescing Process

After the injection, the resultant is held for 30 minutes, and the pH thereof is adjusted to 5.0 by using a 5% sodium hydroxide aqueous solution. Thereafter, the temperature thereof is increased to 90° C. and is held for 2 hours. Substantially spheroidized particles are observed by an optical microscope.

Filtration, Washing, and Drying Process

After the reaction ends, the solution in the flask is cooled and filtered, and thus a solid content is obtained. Next, the solid content is sufficiently washed by ion-exchange water and is then subjected to solid-liquid separation through Nutsche suction filtration, and thus a solid content is obtained again.

Next, the solid content is re-dispersed in 3 liters of ion-exchange water at 40° C. and is stirred and washed at 300 rpm for 15 minutes. The washing operation is repeated 5 times, and the solid content obtained by the solid-liquid separation through the Nutsche suction filtration is subjected to vacuum drying for 12 hours. Thereafter, 0.5 parts by weight of hydrophobic silica (a primary particle size of 16 nm) are added to 100 parts by weight of the solid content, and thus the colored powder coating material (PCA3) made of an acrylic resin is obtained.

The volume-average particle size D50v of the powder particles of the colored powder coating material is 13.5 μm, the volume-average particle size distribution index GSDv is 1.23, and the average circularity is 0.98.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the colored powder coating material (the powder particles thereof) is 0.03% by weight.

Test Example 6: Colored Powder Coating Material (PCE3) Made of Polyester Resin Preparation of Thermosetting Polyester Resin (PES2)

A raw material having the following composition is put into a reaction container provided with a stirrer, a thermometer, a nitrogen gas inlet port, and a rectifier, and is subjected to a polycondensation reaction by increasing the temperature of the raw material to 240° C. while stirring the raw material under a nitrogen atmosphere.

Terephthalic acid: 494 parts by weight (70 mol %)

Isophthalic acid: 212 parts by weight (30 mol %)

Neopentyl glycol: 421 parts by weight (88 mol %)

Ethylene glycol: 28 parts by weight (10 mol %)

Trimethylolethane: 11 parts by weight (2 mol %)

Di-n-butyltin oxide: 0.5 parts by weight

In regard to the obtained thermosetting polyester resin, the glass-transition temperature is 60° C., the acid value (Av) is 7 mg KOH/g, the hydroxyl value (OHv) is 35 mg KOH/g, the weight-average molecular weight is 22,000, and the number-average molecular weight is 7000.

Preparation of Composite Particle Dispersion (E3)

While a jacketed 3-liter reaction vessel (BJ-30N manufactured by Tokyo Rikakikai Co., LTD.) provided with a condenser, a thermometer, a water-dropping device, and an anchor blade is maintained at 40° C. in a water-circulating thermostatic bath, a mixed solvent of 180 parts by weight of ethyl acetate and 80 parts by weight of isopropyl alcohol is injected into the reaction vessel, and the following composition is injected into the resultant.

Thermosetting polyester resin (PES2): 240 parts by weight

Blocked isocyanate thermal curing agent VESTAGON B 1530 (manufactured by Evonik Japan Co., Ltd.): 60 parts by weight Benzoin: 3 parts by weight Acrylic oligomer (Acronal 4F, BASF Company Ltd.): 3 parts by weight After the injection, the resultant is stirred at 150 rpm using a three-one motor to be dissolved, and thus an oil phase is obtained. In the oil phase being stirred, a mixed liquid of 1 part by weight of a 10% by weight an ammonia aqueous solution and 47 parts by weight of a 5% by weight sodium hydroxide aqueous solution is dropped for 5 minutes and is mixed for 10 minutes. Thereafter, 900 parts by weight of ion-exchange water are dropped at a speed of 5 parts by weight per minute for phase inversion, and thus an emulsified liquid is obtained.

800 parts by weight of the obtained emulsified liquid and 700 parts by weight of the ion-exchange water are input into a 2-liter eggplant flask, and the resultant is set in an evaporator (manufactured by Tokyo Rikakikai Co., LTD.) provided with a vacuum control unit via trap balls. While rotating the eggplant flask, the resultant is heated by a hot water bath at 60° C. and is decompressed to 7 kPa while being careful of bumping, and thus a solvent is removed therefrom. At the time when the amount of the solvent being collected becomes 1,100 parts by weight, the pressure is returned to the normal pressure, and the eggplant flask is water-cooled, and thus a dispersion is obtained. There is no solvent odor in the obtained dispersion. The volume-average particle size of the composite particles containing the thermosetting polyester resin and the thermal curing agent in the dispersion is 160 nm.

Thereafter, 2% by weight of an anionic surfactant (DOWFAX 2A1 manufactured by The Dow Chemical Company, the amount of effective components is 45% by weight) is added and mixed as an effective component with respect to the resin component in the dispersion, and the concentration of the solid content thereof is adjusted to 20% by weight by adding ion-exchange water. This is used as a composite particle dispersion (E3) containing the polyester resin and the thermal curing agent.

Preparation of Thermosetting Polyester Resin Particle Dispersion (E4)

A thermosetting polyester resin particle dispersion (E2) is obtained under the same conditions as those for preparing the composite particle dispersion (E1) except that 300 parts by weight of the thermosetting polyester resin (PES2) is used and the blocked isocyanate thermal curing agent, the benzoin, and the acrylic oligomer are not added.

Preparation of Colored Powder Coating Material (PCE3)

Aggregation Process

Composite particle dispersion (E3): 325 parts by weight (the solid content is 65 parts by weight)

Colorant dispersion (C1): 3 parts by weight (the solid content is 0.75 parts by weight)

Colorant dispersion (W1): 150 parts by weight (the solid content is 37.5 parts by weight)

The above components are sufficiently mixed and dispersed by the homogenizer (ULTRA-TURRAX T50 manufactured by IKA Corporation) in a stainless steel round flask. Next, the pH of the resultant is adjusted to 2.5 by using a 1.0% nitric acid aqueous solution. 0.50 parts by weight of a 10% polyaluminum chloride aqueous solution are added thereto, and the dispersing operation is continuously performed by the ULTRA-TURRAX.

A stirrer and a heating mantle are installed, and while appropriately adjusting the rotation frequency of the stirrer so as to sufficiently stir the slurry, the temperature thereof is increased to 40° C. After holding the resultant for 15 minutes at 40° C., 100 parts by weight of the thermosetting polyester resin dispersion (E4) are slowly injected when the volume-average particle size of the resultant becomes 3.5 μm.

Coalescing Process

After the injection, the resultant is held for 30 minutes, and the pH thereof is adjusted to 6.0 by using a 5% sodium hydroxide aqueous solution. Thereafter, the temperature thereof is increased to 85° C. and is held for 2 hours. Substantially spheroidized particles are observed by an optical microscope.

Filtration, Washing, and Drying Process

After the reaction ends, the solution in the flask is cooled and filtered, and thus a solid is obtained. Next, the solid content is sufficiently washed by ion-exchange water and is then subjected to solid-liquid separation through Nutsche suction filtration, and thus a solid content is obtained again.

Next, the solid content is re-dispersed in 3 liters of ion-exchange water at 40° C. and is stirred and washed at 300 rpm for 15 minutes. The washing operation is repeated 5 times, and the solid content obtained by the solid-liquid separation through the Nutsche suction filtration is subjected to vacuum drying for 12 hours. Thereafter, 0.5 parts by weight of hydrophobic silica (a primary particle size of 16 nm) are added to 100 parts by weight of the solid content, and thus the colored powder coating material (PCE3) made of a polyester resin is obtained.

The volume-average particle size D50v of the powder particles of the colored powder coating material is 4.5 μm, the volume-average particle size distribution index GSDv is 1.23, and the average circularity is 0.99.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the colored powder coating material (the powder particles thereof) is 0.02% by weight.

Comparative Test Example 1: Colored Powder Coating Material (PCEX1) Made of Polyester Resin A colored powder coating material (PCEX1) made of a polyester resin is obtained under the same conditions as those in Test Example 2 except that 400 parts by weight of the composite particle dispersion (E1) is used and the addition of 100 parts by weight of the thermosetting polyester resin particle dispersion (E2) is not performed.

The volume-average particle size D50v of the powder particles of the colored powder coating material is 7.5 μm, the volume-average particle size distribution index GSDv is 1.40, and the average circularity is 0.98.

The colored powder coating material (the powder particles thereof) is embedded in an epoxy resin, and the resultant is cut and the cross-sectional image of the powder particles is observed by a transmission electron microscope. It is confirmed that the surface of the powder particle is not coated with the resin coating portion and an additive considered to be the thermal curing agent is exposed to the surface of the powder particle.

The content of aluminum ions in the colored powder coating material (the powder particles thereof) is 0.07% by weight.

Comparative Test Example 2: Clear Powder Coating Material (PCAX1) Made of Acrylic Resin A clear powder coating material (PCAX1) made of an acrylic resin is obtained under the same conditions as those in Test Example 1 except that the content of the polyaluminum chloride is reduced to 0.1 parts by weight, 40 parts by weight of a 10% NTA (nitrilotriacetic acid) metal salt aqueous solution (CHELEST 70 manufactured by Chelest Co., Ltd.) are added in the coalescing process, and the pH thereof is then adjusted to 6.0 by using a 5% sodium hydroxide aqueous solution.

The volume-average particle size D50v of the powder particles of the clear powder coating material is 9.0 μm, the volume-average particle size distribution index GSDv is 1.53, and the average circularity is 0.99.

The clear powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the clear powder coating material (the powder particles thereof) is 0.001% by weight.

Comparative Test Example 3: Clear Powder Coating Material (PCAX2) Made of Acrylic Resin A clear powder coating material (PCAX2) made of an acrylic resin is obtained under the same conditions as those in Test Example 1 except that the content of the polyaluminum chloride is increased to 3 parts by weight.

The volume-average particle size D50v of the powder particles of the clear powder coating material is 8.2 μm, the volume-average particle size distribution index GSDv is 1.30, and the average circularity is 0.95.

The clear powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the clear powder coating material (the powder particles thereof) is 0.25% by weight.

Comparative Test Example 4: Colored Powder Coating Material (PCEX2) Made of Polyester Resin A colored powder coating material (PCEX2) made of a polyester resin is obtained under the same conditions as those in Test Example 6 except that the content of the polyaluminum chloride is reduced to 0.2 parts by weight, 40 parts by weight of a 10% NTA (nitrilotriacetic acid) metal salt aqueous solution (CHELEST 70 manufactured by Chelest Co., Ltd.) are added in the coalescing process, and the pH thereof is then adjusted to 6.0 by using a 5% sodium hydroxide aqueous solution. The volume-average particle size D50v of the powder particles of the colored powder coating material is 5.0 μm, the volume-average particle size distribution index GSDv is 1.55, and the average circularity is 0.99.

The clear powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the clear powder coating material (the powder particles thereof) is 0.0016% by weight.

Test Example 7: Colored Powder Coating Material (PCE4) Made of Polyester Resin

A colored powder coating material (PCEX4) made of a polyester resin is obtained under the same conditions as those in Test Example 6 except that the content of the polyaluminum chloride is increased to 2 parts by weight.

The volume-average particle size D50v of the powder particles of the colored powder coating material is 5.5 μm, the volume-average particle size distribution index GSDv is 1.30, and the average circularity is 0.97.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the colored powder coating material (the powder particles thereof) is 0.22% by weight.

Test Example 8: Colored Powder Coating Material (PME1) Made of Polyester Resin

A colored powder coating material (PME1) is obtained in the same method as that of the colored powder coating material (PCE1) in Test Example 2 except that 306.5 parts by weight of the composite particle dispersion (E1) is used and 4.8 parts by weight of the colorant dispersion (M1) is used instead of the colorant dispersion (C1).

The volume-average particle size D50v of the powder particles of the colored powder coating material is 6.4 μm, the volume-average particle size distribution index GSDv is 1.23, and the average circularity is 0.98.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the colored powder coating material (the powder particles thereof) is 0.1% by weight.

Test Example 9: Colored Powder Coating Material (PME2) Made of Polyester Resin

A colored powder coating material (PME2) is obtained in the same method as that of the colored powder coating material (PCE1) in Test Example 2 except that 305 parts by weight of the composite particle dispersion (E1) is used and 6 parts by weight of the colorant dispersion (M2) is used instead of the colorant dispersion (C1).

The volume-average particle size D50v of the powder particles of the colored powder coating material is 6.6 μm, the volume-average particle size distribution index GSDv is 1.22, and the average circularity is 0.98.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the colored powder coating material (the powder particles thereof) is 0.1% by weight.

Test Example 10: Colored Powder Coating Material (PYE1) Made of Polyester Resin

A colored powder coating material (PYE1) is obtained in the same method as that of the colored powder coating material (PCE1) in Test Example 2 except that 302.5 parts by weight of the composite particle dispersion (E1) is used and 8 parts by weight of a colorant dispersion (Y1) is used instead of the colorant dispersion (C1).

The volume-average particle size D50v of the powder particles of the colored powder coating material is 6.8 μm, the volume-average particle size distribution index GSDv is 1.24, and the average circularity is 0.96.

The colored powder coating material (the powder particles thereof) is embedded in an epoxy resin, and the resultant is cut and the cross-sectional image of the powder particles is observed by a transmission electron microscope. It is confirmed that the surface of the powder particle is coated with the resin coating portion.

In addition, the content of aluminum ions in the colored powder coating material (the powder particles thereof) is 0.12% by weight.

Test Example 11: Colored Powder Coating Material (PKE1) Made of Polyester Resin

A colored powder coating material (PKE1) is obtained in the same method as that of the colored powder coating material (PCE1) in Test Example 2 except that 309 parts by weight of the composite particle dispersion (E1) is used and 2.8 parts by weight of a colorant dispersion (K1) is used instead of the colorant dispersion (C1).

The volume-average particle size D50v of the powder particles of the colored powder coating material is 6.5 μm, the volume-average particle size distribution index GSDv is 1.22, and the average circularity is 0.98.

The colored powder coating material (the powder particles thereof) is embedded in an epoxy resin, and the resultant is cut and the cross-sectional image of the powder particles is observed by a transmission electron microscope.

It is confirmed that the surface of the powder particle is coated with the resin coating portion.

In addition, the content of aluminum ions in the colored powder coating material (the powder particles thereof) is 0.09% by weight.

Evaluations

Preparation of Coating Film Sample of Powder Coating Material

A test panel of a zinc phosphate-treated steel sheet is coated with the powder coating material obtained in each of the examples by an electrostatic coating method, and the resultant is then heated (baked) at a heating temperature of 180° C. for a heating time of 1 hour, and thus a coating film sample having a thickness of 30 μm is obtained.

Evaluation of Blocking Resistance

The powder coating material obtained in each of the examples is stored in a thermo-hygrostat bath in which the temperature and the humidity are respectively controlled to 50° C. and 50 RH %, for 17 hours and is sieved by a vibrating sieve, and thereafter the amount of the powder coating material being passed through 200 meshes (an opening of 75 micrometers) is examined. Evaluation is performed based on the following criteria.

G1: a passage amount of 90% or higher

NG: a passage amount of less than 90%

Details and evaluation results of each of the Examples and Comparative Examples are listed in Table 1.

TABLE 1

| | | Test Example 1 | Test Example 2 | Test Example 3 | Test Example 4 | Comparative Test Example 1 | Comparative Test Example 2 | Comparative Test Example 3 |
|---|---|---|---|---|---|---|---|---|
| Properties of Powder Coating Material | Sample ID | PCA1 | PCE1 | PCE2 | PCA2 | PCEX1 | PCAX1 | PCAX2 |
| | D50v (μm) | 5.9 | 6.5 | 6.8 | 7.0 | 7.5 | 9.0 | 8.2 |
| | GSDv | 1.20 | 1.24 | 1.22 | 1.35 | 1.40 | 1.53 | 1.30 |
| | Average Circularity | 0.99 | 0.98 | 0.99 | 0.97 | 0.98 | 0.99 | 0.95 |
| | Presence or Absence of Resin Coating portion | Present | Present | Present | Present | Absent | Present | Present |
| | Content of Metal Ions (%) | 0.08 | 0.1 | 0.005 | 0.17 | 0.07 | 0.001 | 0.25 |
| Evaluation | Surface Roughness Ra of Coating Film (μm) | 0.3 | 0.3 | 0.2 | 0.4 | 0.6 | 0.7 | 0.8 |
| | Glossiness of Coating Film (%) | 96 | 95 | 97 | 95 | 92 | 87 | 77 |
| | Blocking Resistance of Powder Coating Material | G1 | G1 | G1 | G1 | NG | G1 | G1 |

| | | Test Example 5 | Test Example 6 | Comparative Test Example 4 | Test Example 7 | Test Example 8 | Test Example 9 | Test Example 10 | Test Example 11 |
|---|---|---|---|---|---|---|---|---|---|
| Properties of Powder Coating Material | Sample ID | PCA3 | PCE3 | PCEX2 | PCE4 | PME1 | PME2 | PYE1 | PKE1 |
| | D50v (μm) | 13.5 | 4.5 | 5.0 | 5.5 | 6.4 | 6.6 | 6.8 | 6.5 |
| | GSDv | 1.23 | 1.23 | 1.55 | 1.30 | 1.23 | 1.22 | 1.24 | 1.22 |
| | Average Circularity | 0.98 | 0.99 | 0.99 | 0.97 | 0.98 | 0.98 | 0.96 | 0.98 |
| | Presence or Absence of Resin Coating portion | Present | Present | Present | Present | Present | Present | Present | Present |
| | Content of Metal Ions (%) | 0.03 | 0.02 | 0.0016 | 0.22 | 0.1 | 0.1 | 0.12 | 0.09 |
| Evaluation | Surface Roughness Ra of Coating Film (μm) | 0.3 | 0.1 | 0.3 | 0.6 | 0.3 | 0.3 | 0.4 | 0.2 |
| | Glossiness of Coating Film (%) | 95 | 98 | 95 | 90 | 95 | 94 | 91 | 95 |
| | Blocking Resistance of Powder Coating Material | G1 | G1 | NG | G1 | G1 | G1 | G1 | G1 |

Evaluation of Smoothness of Coating Film

The center-line average roughness (hereinafter, referred to as "Ra", unit: μm) of the surface of the coating film sample is measured by using a surface roughness meter (SURFCOM 1400A of Tokyo Seimitsu Co., Ltd.). As the value of the Ra increases, the smoothness of the surface decreases, and 0.5 μm is a good level.

Evaluation of Glossiness of Coating Film

The 600 specular gloss value (unit: %) of the surface of the coating film sample is measured by using a gloss meter (micro-TRI-gloss of BYK-Gardner). As the value thereof increases, glossiness increases, and 90% or higher is a good level.

From the results described above, it is shown that in Test Examples, even when the volume average particle diameter decreases to be equal to or less than 15 μm, a coating film having low surface roughness and high glossiness is able to be obtained, compared to Comparative Test Examples. In addition, it is shown that in Test Examples, the blocking resistance of the powder coating material is also excellent, compared to Comparative Test Examples.

Therefore, it may be seen that, compared to the powder coating materials of Comparative Test Examples, the powder coating materials of Test Examples form a coating film having high smoothness with a small amount of a raw material and have high storage properties even when the powder particles are reduced in diameter.

It is shown from the above that when the powder coating material according to this exemplary embodiment is applied to the powder coating apparatus according to this exemplary embodiment, the coating film is formed in the concave portion of the object to be coated having concavities and convexities on the surface to be coated, and even when the powder particles are reduced in diameter, the coating film having high smoothness is formed with a small amount of powder particles.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder coating apparatus, comprising:

a transporter that transports an object to be coated;

an applying unit disposed to be opposed to a surface to be coated of the transported object to be coated and applying a charged thermosetting powder coating material onto the surface to be coated of the object to be coated, wherein the applying unit includes an applying section including a cylindrical or columnar applying member that is disposed to be separated from the surface to be coated of the object to be coated, is rotated in a direction identical to or opposite from a transport direction of the object to be coated, and transfers and applies the powder coating material attached to the surface of the applying member onto the surface to be coated of the object to be coated according to a potential difference between the applying member and the surface to be coated of the object to be coated, and a supplying section including a cylindrical or columnar supplying member that supplies the powder coating material onto the surface of the applying member;

a voltage applying device that includes a voltage applying unit applying a voltage in which an alternating voltage is superimposed with a direct voltage applying a potential difference between the applying member and the surface to be coated of the object to be coated;

a heater that heats and thermally cures a powder particle layer of the powder coating material applied onto the surface to be coated of the object to be coated;

a height measurer for a surface to be coated that measures a height of the surface to be coated of the object to be coated from a transport surface on an upstream side of the applying unit in the transport direction of the object to be coated;

a discharge voltage measurer that includes a discharge electrode disposed to be separated from the surface to be coated of the object to be coated on the upstream side of the applying unit in the transport direction of the object to be coated, applies a signal voltage to the discharge electrode, and measures a voltage discharged between the discharge electrode and the surface to be coated of the object to be coated; and a controller configured to control the voltage applying unit such that an amplitude of the alternating voltage of the voltage applying unit is determined and the direct voltage superimposed with the alternating voltage is applied in accordance with the measured height and discharged voltage.

2. The powder coating apparatus according to claim 1, wherein the applying unit further includes an electrode plate that is disposed between the surface to be coated of the object to be coated and the applying member, and includes an opening portion.

3. The powder coating apparatus according to claim 1, further comprising:

an eraser that erases the surface to be coated of the object to be coated on the upstream side of the applying unit in the transport direction of the object to be coated.

4. The powder coating apparatus according to claim 1, wherein the controller is also configured to control a speed ratio between a transport speed of the object to be coated and a rotational speed of the applying member such that a thickness of the powder particle layer of the powder coating material that is applied onto the surface to be coated of the object to be coated by the applying unit is a predetermined thickness.

5. The powder coating apparatus according to claim 1, wherein the supplying section includes a plurality of supplying members that is arranged along a circumferential direction of the applying member as the supplying member.

6. The powder coating apparatus according to claim 1, wherein a plurality of applying units that is arranged in the transport direction of the object to be coated is provided as the applying unit.

7. The powder coating apparatus according to claim 6, wherein at least one applying unit among the plurality of applying units applies a powder coating material having a color different from that of another applying unit of the plurality of applying units onto the surface to be coated of the object to be coated.

8. The powder coating apparatus according to claim 6, wherein the powder coating apparatus includes a plurality of heaters respectively heating and thermally curing the powder particle layer of the powder coating material that is applied onto the surface to be coated of the object to be coated by the plurality of applying units as the heater.

9. The powder coating apparatus according to claim 1, wherein a volume-based particle size distribution index GSDv of the thermosetting powder coating material is equal to or less than 1.50, and average circularity of powder particles is greater than or equal to 0.96.

10. The powder coating apparatus according to claim 1, wherein the thermosetting powder coating material includes at least one type selected from the group consisting of a thermosetting (meth)acrylic resin and a thermosetting polyester resin.

11. The powder coating apparatus according to claim 10, wherein a number-average molecular weight of the thermosetting (meth)acrylic resin is from 1,000 to 20,000.

12. The powder coating apparatus according to claim 10, wherein a sum of an acid value and a hydroxyl value of the thermosetting polyester resin is from 10 mgKOH/g to 250 mgKOH/g.

13. The powder coating apparatus according to claim 10, wherein a number-average molecular weight of the thermosetting polyester resin is from 1,000 to 100,000.

14. The powder coating apparatus according to claim 10, wherein a content of a resin of the thermosetting powder coating material is from 20% by weight to 99% by weight with respect to total powder particles.

15. The powder coating apparatus according to claim 1, wherein the thermosetting powder coating material contains a thermosetting resin and a thermal curing agent, and a content of the thermal curing agent of the thermosetting powder coating material is from 1% by weight to 30% by weight with respect to the thermosetting resin.

16. The powder coating apparatus according to claim 1, wherein the thermosetting powder coating material has a core-shell structure.

17. The powder coating apparatus according to claim 16, wherein a coverage of a shell portion of the thermosetting powder coating material is from 30% to 100%.

18. The powder coating apparatus according to claim 1, wherein the thermosetting powder coating material contains a metal ion of 0.002% by weight to 0.2% by weight with respect to total powder particles.

19. The powder coating apparatus according to claim 1, wherein the thermosetting powder coating material contains an external additive of 0.01% by weight to 5% by weight with respect to powder particles.

* * * * *